US008102363B2

(12) United States Patent
Hirayama

(10) Patent No.: US 8,102,363 B2
(45) Date of Patent: Jan. 24, 2012

(54) ELECTROPHORESIS DISPLAY DEVICE, ELECTROPHORESIS DISPLAY DEVICE DRIVING METHOD, AND ELECTRONIC APPARATUS

(75) Inventor: Hiroshi Hirayama, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 811 days.

(21) Appl. No.: 12/177,574

(22) Filed: Jul. 22, 2008

(65) Prior Publication Data

US 2009/0058797 A1 Mar. 5, 2009

(30) Foreign Application Priority Data

Aug. 30, 2007 (JP) ..... 2007-224395

(51) Int. Cl.
*G09G 3/34* (2006.01)

(52) U.S. Cl. ..... 345/107; 345/105; 345/106; 345/84; 345/85; 345/86

(58) Field of Classification Search ..... 345/33, 345/76, 84, 87, 105–107, 204, 690, 211–214; 359/273, 296; 347/111, 112, 153, 167; 430/19
See application file for complete search history.

(56) References Cited

U.S. PATENT DOCUMENTS 5,315,312 A * 5/1994 DiSanto et al. ..... 345/107
5,359,346 A * 10/1994 DiSanto et al. ..... 345/107
5,627,561 A * 5/1997 Laspina et al. ..... 345/107
6,774,879 B2 * 8/2004 Miyamoto et al. ..... 345/84
7,342,556 B2 * 3/2008 Oue et al. ..... 345/33
7,733,311 B2 * 6/2010 Amundson et al. ..... 345/87
7,868,869 B2 * 1/2011 Shin et al. ..... 345/107
2002/0003895 A1 * 1/2002 Some ..... 382/132
2002/0009655 A1 * 1/2002 Miyamoto et al. ..... 430/19
2002/0033792 A1 * 3/2002 Inoue ..... 345/107
2004/0145696 A1 * 7/2004 Oue et al. ..... 349/167
2005/0001812 A1 * 1/2005 Amundson et al. ..... 345/107
2005/0024353 A1 * 2/2005 Amundson et al. ..... 345/204
2005/0219184 A1 * 10/2005 Zehner et al. ..... 345/89
2006/0139310 A1 * 6/2006 Zehner et al. ..... 345/107
2006/0139311 A1 * 6/2006 Zehner et al. ..... 345/107
2008/0143668 A1 * 6/2008 Shin et al. ..... 345/107
2008/0212163 A1 * 9/2008 Matsui ..... 359/296
2009/0231316 A1 * 9/2009 Gillies ..... 345/211

FOREIGN PATENT DOCUMENTS

JP 2002-149115 5/2002

* cited by examiner

*Primary Examiner* — Prabodh M Dharia
(74) *Attorney, Agent, or Firm* — AdvantEdge Law Group, LLC

(57) ABSTRACT

In at least one embodiment, a driving method of an electrophoresis display device includes an image-erasing step in which an old image displayed on the displaying section of the electrophoresis display device is erased. The image-erasing step of the driving method of the electrophoresis display device further includes a first image-erasing sub step of displaying a first gradation in each of the pixels of a first area and displaying a second gradation in each of the pixels of a second area; and a second image-erasing sub step of displaying the second gradation in each of the pixels of the first area and displaying the first gradation in each of the pixels of the second area.

18 Claims, 14 Drawing Sheets

ELECTROPHORESIS DISPLAY DEVICE, ELECTROPHORESIS DISPLAY DEVICE DRIVING METHOD, AND ELECTRONIC APPARATUS

BACKGROUND

1. Technical Field

The present invention relates to an electrophoresis display device, a method for driving an electrophoresis display device, and an electronic apparatus that is provided with an electrophoresis display device.

2. Related Art

In the technical field to which the present invention pertains, some active-matrix-driven electrophoresis display devices that are provided with a pixel-driving/switching element and a memory circuit for each of a plurality of pixels thereof are known. An example of an electrophoresis display device of the related art that has such an individual ("pixel-by-pixel") switching and memory circuit configuration is described in JP-A-2002-149115.

A typical example of a method for driving such an electrophoresis display device of the related art is as follows. Prior to the displaying of each new image, the entire display screen area of an image display unit (hereafter referred to as a display unit) is put into a "white display" state. This is done in order to erase an old (e.g., preceding) image before the display unit displays a new image on the display screen thereof. In this way, an electrophoresis display device of the related art, an example of which is disclosed in JP-A-2002-149115, updates image display. Herein, the term "updates" is used to mean, for example, rewrites, renews, or refreshes, though not limited thereto.

The typical electrophoresis-display-device driving method of the related art described above has not yet fully addressed the technical aspect of a residual image. That is, an afterimage will remain if an old image is erased by means of the typical method for driving an electrophoresis display device of the related art. In the following description, the mechanism of the occurrence of an afterimage is briefly explained. FIG. 15 is a diagram that schematically illustrates an example of the occurrence of an afterimage at the time of image-erasing operation of an electrophoresis display device of the related art. The left-side part (a) of FIG. 15 shows a "half-black and half-white display" state where the upper-half display area 1031 of an entire display area 1030 is in a "black display" state whereas the lower-half display area 1032 of the entire display area 1030 is in a "white display" state. If the entire display screen area of the display unit 1030 is put into a white display state in order to erase an old half-black-and-half-white image before the display unit 1030 displays a new image on the display screen thereof, a blackish afterimage occurs/remains in the upper-half display area 1031 of the entire display area 1030 as illustrated in the right-side part (b) of FIG. 15.

The reason why such a residual image occurs or remains is that, generally speaking, an electrophoresis display device has relatively low display-update responsiveness. Or, in other words, each display state of an electrophoresis display device tends to be affected by its preceding/previous display state. For this reason, a single execution of white display is most likely not enough to fully agitate white particles, which is an example of one component of electrophoresis particles, and black particles, which is an example of the other component of electrophoresis particles, resulting in unsatisfactory electrophoresis image display quality. In the preceding sentence as well as in the following description, the term "agitate" is used in the meaning of uniformize or mix as a result of "stirring" movement of particles, without any limitation thereto.

In an effort to address the technical aspect of a residual image and to overcome the slow display-update responsiveness of an electrophoresis display device, a driving method that repeats, or performs more than once, black display and white display in an alternate manner has been proposed in the related art. In the following description, an improved method for driving an electrophoresis display device of the related art that adopts repetitive black/white display-state switchover is explained.

FIG. 16 is a display-state transition diagram that schematically illustrates the image pattern of a display unit 1130 of a related-art electrophoresis display device where such a display-state transition occurs at the time of image-erasing operation thereof. In FIG. 16, the upper-half display area of the entire screen area of the display unit 1130 is denoted as 1131, whereas the lower-half display area of the entire screen area of the display unit 1130 is denoted as 1132. The initial display state (a) of the display-state transition diagram of FIG. 16 corresponds to the left-side part (a) of FIG. 15, which shows a half-black and half-white display state. Specifically, the upper-half display area 1131 of the entire display area 1130 is in a black display state whereas the lower-half display area 1132 of the entire display area 1130 is in a white display state. The display states (b), (c), (d), (e), (f), and (g) of FIG. 16 show a series of display-state transition operation of an electrophoresis display device of the related art in which the entire screen area of the display unit 1130 is put into a black display state and then into a white display state and thereafter back into a black display state . . . in a repetitive and an alternate manner so as to erase an old image.

FIGS. 17A and 17B is a set of diagrams that schematically illustrates an example of the migration behavior, for example, movement, of white particles 1182, which is an example of one component of electrophoresis particles, and black particles 1183, which is an example of the other component of electrophoresis particles at the time of image-erasing operation of an electrophoresis display device of the related art. FIG. 17A corresponds to the transition operation of an electrophoresis display device of the related art from the display state (a) shown in FIG. 16 to the display state (b) shown therein. On the other hand, FIG. 17B corresponds to the transition operation of an electrophoresis display device of the related art from the display state (b) shown in FIG. 16 to the display state (c) shown therein. Each of the upper-half display area 1131 and the lower-half display area 1132 is made up of an array of a plurality of (a number of) pixels. It is assumed herein just for the purpose of explanation and thus without any intention to limit the scope of the invention that the white particles 1182 are charged negatively whereas the black particles 1183 are charged positively. In addition, it is further assumed that one side at which a common electrode 1122 is provided is/constitutes the image-display-surface side of this electrophoresis display device.

As has already been described above, the upper-half display area 1131 of the entire display area 1130 is in a black display state whereas the lower-half display area 1132 of the entire display area 1130 is in a white display state in the initial display state (a) of the display-state transition diagram shown in FIG. 16. Pixel electrodes 1121A are arrayed in and thus make up the upper-half display area 1131. Pixel electrodes 1121B are arrayed in and thus make up the lower-half display area 1132. It is assumed that a high electric potential (i.e., high voltage) H is applied to the pixel electrodes 1121A and 1121B whereas a low electric potential L is applied to the common electrode 1122 when the display unit 1130 is in the initial display state (a) of FIG. 16. Through the inputting of a high electric potential H into the pixel electrodes 1121A arrayed at the upper-half display area 1131 and the pixel electrodes 1121B arrayed at the lower-half display area 1132 as well as the inputting of a low electric potential L into the common electrode 1122, electrophoresis particles behave as illustrated in the center one of three diagrams of FIG. 17A. It should be noted that the white particles 1182 and the black particles 1183 do not move (e.g., migrate) in the upper-half display area 1131 in response thereto because the upper-half display area 1131 is in a black display state at its initial status, that is, before (and after) the application of a high voltage H to the pixel electrodes 1121A arrayed at the upper-half display area 1131 and the application of a low voltage L to the common electrode 1122. In contrast thereto, in the lower-half display area 1132, the black particles 1183 are drawn to, and gather at, the common electrode 1122 whereas the white particles 1182 are drawn to, and gather at, the pixel electrodes 1121B arrayed at the lower-half display area 1132 in response to the application of a high voltage H to the pixel electrodes 1121B arrayed at the lower-half display area 1132 and the application of a low voltage L to the common electrode 1122. The result of the above-explained behavior/movement of electrophoresis particles is illustrated in the bottom one of three diagrams of FIG. 17A. As a result thereof, as illustrated in the state diagram (b) of FIG. 16, the lower half display area 1132 transitions into a black display state.

Next, it is assumed that a low electric potential L is applied to the pixel electrodes 1121A and 1121B whereas a high electric potential H is applied to the common electrode 1122 when the display unit 1130 is in the display state (b) of FIG. 16. Through the inputting of a low electric potential L into the pixel electrodes 1121A arrayed at the upper-half display area 1131 and the pixel electrodes 1121B arrayed at the lower-half display area 1132 as well as the inputting of a high electric potential H into the common electrode 1122, electrophoresis particles behave as illustrated in the center one of three diagrams of FIG. 17B. In response to the application of a low voltage L to the pixel electrodes 1121A arrayed at the upper-half display area 1131 and the pixel electrodes 1121B arrayed at the lower-half display area 1132 as well as the application of a high voltage H to the common electrode 1122, in each of the upper-half display area 1131 and the lower-half display area 1132, the white particles 1182 are drawn to, and gather at, the common electrode 1122. On the other hand, the black particles 1183 are drawn to, and gather at, the pixel electrodes 1121A arrayed at the upper-half display area 1131 and the pixel electrodes 1121B arrayed at the lower-half display area 1132. The result of the above-explained behavior/movement of electrophoresis particles is illustrated in the bottom one of three diagrams of FIG. 17B. That is, as a result thereof, as illustrated in the state diagram (c) of FIG. 16, each of the upper-half display area 1131 and the lower-half display area 1132 transitions into a white display state. As has already been explained above, generally speaking, an electrophoresis display device has relatively low display-update responsiveness. That is, each display state of an electrophoresis display device tends to be affected by its preceding/previous display state. For this reason, the whiteness level of white display offered by the upper-half display area 1131 at the display state (c) of FIG. 16 is relatively low (i.e., more darkish) in comparison with the whiteness level of white display offered by the lower-half display area 1132 at the display state (c) of FIG. 16. Note that the upper-half display area 1131 was in a black display state at its initial state, which tends to affect the subsequent display state (herein the display state (c) of FIG. 16). A difference in the whiteness level of white display offered by the upper-half display area 1131 (at the display state (c) of FIG. 16) and the whiteness level of white display offered by the lower-half display area 1132 (at the display state (c) of FIG. 16) is observed or perceived as an afterimage, that is, a residual image. Thereafter, the entire screen area of the display unit 1130 is put into a black display state (d) of FIG. 16 and then into a white display state (e) thereof in an alternate manner. Because of the relatively low display-update responsiveness of an electrophoresis display device described above, the whiteness level of white display offered by the upper-half display area 1131, which was in a black display state at its initial state that tends to affect the subsequent display state (herein the display state (e) of FIG. 16), at the display state (e) of FIG. 16 is relatively low (i.e., slightly more darkish) in comparison with the whiteness level of white display offered by the lower-half display area 1132 at the display state (e) of FIG. 16. A difference in the whiteness level of white display offered by the upper-half display area 1131 (at the display state (e) of FIG. 16) and the whiteness level of white display offered by the lower-half display area 1132 (at the display state (e) of FIG. 16) is perceived as an afterimage. Thereafter, the entire screen area of the display unit 1130 is put into a black display state (f) of FIG. 16 and then into a white display state (g) thereof in an alternate manner. After further image-erasing operation described above, the whiteness level of white display offered by the upper-half display area 1131 at the display state (g) of FIG. 16 is substantially/almost the same as the whiteness level of white display offered by the lower-half display area 1132 at the display state (g) of FIG. 16. This means that a residual image is substantially reduced at this display state (g) of FIG. 16.

Although the proposed method for driving an electrophoresis display device of the related art, which repeats black display states and white display states in an alternate manner as explained above, makes it possible to achieve image-erasing operation without causing any perceivable afterimage, it has a disadvantage in that a user will perceive the blinking of an image/screen during the execution of image-erasing operation because black display and white display appear successively in an alternate manner as will be understood from the foregoing explanation and illustration in FIG. 16. Such an image-blink phenomenon, which is uncomfortable to users, is hereafter referred to as "flashing". The flashing causes visual stress for users, which is a part of several factors that discourage the widespread use of electronic paper.

SUMMARY

An advantage of some aspects of the invention is to provide an electrophoresis display device that makes it possible to achieve significant reduction in flashing at the time of display-updating operation. In addition, the invention provides, as an advantage of some aspects thereof, a method for driving such an electrophoresis display device and an electronic apparatus that is provided with such an electrophoresis display device. Another advantage of some aspects of the invention is to provide an electrophoresis display device that makes it possible to avoid the occurrence of any afterimage problem and thus offer enhanced image display quality. Moreover, the invention provides, as another advantage of some aspects thereof, a method for driving such an electrophoresis display device and an electronic apparatus that is provided with such an electrophoresis display device.

In order to address the above-identified problems without any limitation thereto, an electrophoresis display device according to an aspect of the invention, an electrophoresis-display-device driving method according to an aspect of the invention, and an electronic apparatus according to an aspect of the invention adopts any of the following novel and non-obvious configurations and/or features.

The invention provides, as a first aspect thereof, a method for driving an electrophoresis display device that has a pair of substrates that sandwich an electrophoresis element that contains, without any limitation thereto, a plurality of electrophoresis particles and further has a displaying section that is made up of a plurality of pixels, the driving method of the electrophoresis display device comprising: an image-erasing step in which an old image displayed on the displaying section of the electrophoresis display device is erased, the image-erasing step of the driving method of the electrophoresis display device further including a first image-erasing sub step of displaying a first gradation in each of the pixels of first areas and displaying a second gradation in each of the pixels of second areas, where the pixels are grouped into the first areas and the second areas arrayed adjacent to each other in the displaying section of the electrophoresis display device, each of the first areas being made up of either a single pixel or plural pixels, each of the second areas being also made up of either a single pixel or plural pixels; and a second image-erasing sub step of displaying the second gradation in each of the pixels of the first areas and displaying the first gradation in each of the pixels of the second areas.

In the driving method of the electrophoresis display device according to the first aspect of the invention described above, the image-erasing step is executed while displaying gradations that differ from each other in the first areas and the second areas in an alternate switchover manner. The pixels are grouped into the first areas and the second areas arrayed adjacent to each other in the displaying section of the electrophoresis display device, where each of the first areas is made up of either a single pixel or plural pixels whereas each of the second areas is also made up of either a single pixel or plural pixels. Accordingly, when the first image-erasing sub step and the second image-erasing sub step are executed in an alternate manner, the mixed color of the above-mentioned different gradations displayed in the first areas and the second areas in an alternate switchover manner is perceived by a user when viewed with the naked eye. Therefore, the invention provides, as an advantage of the first aspect thereof, a method for driving an electrophoresis display device that makes it possible to significantly reduce flashing at the time of display-updating operation.

In the driving method of the electrophoresis display device according to the first aspect of the invention described above, it is preferable that the first image-erasing sub step and the second image-erasing sub step should be executed more than one time in an alternate manner.

With the preferred driving method of the electrophoresis display device according to the first aspect of the invention described above, it is possible to fully agitate the electrophoresis particles while effectively preventing or suppressing the occurrence of flashing. Thus, it is possible to improve image display quality while effectively preventing or suppressing a residual image.

In the driving method of the electrophoresis display device according to the first aspect of the invention described above, it is preferable that a plurality of data lines and a plurality of scanning lines that intersect with each other should be formed in the displaying section of the electrophoresis display device; each of the pixels should be formed at a position corresponding to the intersection of the data line and the scanning line; and the first areas and the second areas should be arrayed in a grid pattern along the extending direction of the data lines and the extending direction of the scanning lines.

With the preferred driving method of the electrophoresis display device according to the first aspect of the invention described above, it is possible to divide the displaying section of the electrophoresis display device into minute areas, that is, the first areas and the second areas arrayed in a grid pattern along the extending direction of the data lines and the extending direction of the scanning lines. For this reason, when the first image-erasing sub step and the second image-erasing sub step are executed in an alternate manner, the mixed color of the above-mentioned different gradations displayed in the first areas and the second areas in an alternate switchover manner is perceived by a user when viewed with the naked eye. Therefore, the preferred driving method of the electrophoresis display device according to the first aspect of the invention described above makes it possible to significantly reduce flashing at the time of display-updating operation.

In the preferred driving method of the electrophoresis display device according to the first aspect of the invention described above, it is further preferable that each of the first areas should be made up of not plural pixels but a single pixel and that each of the second areas should also be made up of not plural pixels but a single pixel.

With the preferred driving method of the electrophoresis display device according to the first aspect of the invention described above, it is possible to minimize the unit area size of the first areas and the second areas. For this reason, it is possible to make the difference in gradations that are displayed in the first areas and the second areas in an alternate switchover manner less perceivable when viewed with the naked eye. Therefore, the preferred driving method of the electrophoresis display device according to the first aspect of the invention described above makes it possible to significantly reduce flashing at the time of display-updating operation.

In the driving method of the electrophoresis display device according to the first aspect of the invention described above, it is preferable that a plurality of data lines and a plurality of scanning lines that intersect with each other should be formed in the displaying section of the electrophoresis display device; each of the pixels should be formed at a position corresponding to the intersection of the data line and the scanning line; each of the first areas should be elongated along the extending direction of the data lines; and each of the second areas should also be elongated along the extending direction of the data lines.

With the preferred driving method of the electrophoresis display device according to the first aspect of the invention described above, since it is possible to hold the electric potential of the data line at a certain level until display data has been inputted into every pixel in the first image-erasing sub step and the second image-erasing sub step, it is possible to reduce the burden of the control of the electric potential levels of the data lines therein.

In the driving method of the electrophoresis display device according to the first aspect of the invention described above, it is preferable that a plurality of data lines and a plurality of scanning lines that intersect with each other should be formed in the displaying section of the electrophoresis display device; each of the pixels should be formed at a position corresponding to the intersection of the data line and the scanning line; each of the first areas should be elongated along the extending direction of the scanning lines; and each of the second areas should also be elongated along the extending direction of the scanning lines.

With the preferred driving method of the electrophoresis display device according to the first aspect of the invention described above, it is possible to achieve a uniform electric potential for all data lines in the first image-erasing sub step and the second image-erasing sub step because the same single display data is inputted into all pixels of a certain row group that are connected to the same single scanning line. For this reason, it is possible to reduce the burden of the control of the electric potential levels of the data lines therein.

It is preferable that the method for driving the electrophoresis display device according to the first aspect of the invention described above should further comprise an image-writing step in which an image is displayed in the displaying section of the electrophoresis display device, wherein a plurality of pixel electrodes is formed on one of the pair of substrates; a common electrode is formed on the other of the pair of substrates in such a manner that the common electrode is provided opposite to the plurality of pixel electrodes with the electrophoresis element being interposed therebetween; either a first electric potential or a second electric potential is inputted into some pixel electrodes in the first image-erasing sub step of the image-erasing step; either the first electric potential or the second electric potential is inputted into some pixel electrodes in the second image-erasing sub step of the image-erasing step; either the first electric potential or the second electric potential is inputted into some pixel electrodes in the image-writing step; and a signal that causes the electric potential level of the common electrode to switch over between the first electric potential and the second electric potential in an alternate manner is inputted into the common electrode in each of the first image-erasing sub step of the image-erasing step, the second image-erasing sub step of the image-erasing step, and the image-writing step.

With the preferred driving method of the electrophoresis display device according to the first aspect of the invention described above, it is possible to secure a time period during which there occurs a voltage level difference between the electric potential of the pixel electrode and the electric potential of the common electrode regardless of whether the first electric potential is inputted into the pixel electrode or the second electric potential is inputted into the pixel electrode. For this reason, the preferred driving method of the electrophoresis display device according to the first aspect of the invention described above makes it possible to rewrite/update the pixels having different gradations in a concurrent manner.

In the preferred driving method of the electrophoresis display device according to the first aspect of the invention described above, it is further preferable that each of the length of the time period of the first image-erasing sub step and the length of the time period of the second image-erasing sub step should be shorter than each of the length of the time period during which the electric potential level of the signal that is inputted into the common electrode in the image-writing step in which an image is displayed in the displaying section of the electrophoresis display device is held at the first electric potential and the length of the time period during which the electric potential level of the signal that is inputted into the common electrode in the image-writing step in which an image is displayed in the displaying section of the electrophoresis display device is held at the second electric potential.

In the preferred driving method of the electrophoresis display device according to the first aspect of the invention described above, each of the writing level of the first image-erasing sub step and the writing level of the second image-erasing sub step is relatively low (i.e., "weaker writing") in comparison with that of the image-writing step. Because of the lesser writing intensity in the pixel-writing operation of the image-erasing step, the electrophoresis particles do not move completely to the pixel electrode/common electrode when they migrate toward the pixel electrode/common electrode during the execution of the image-erasing step. Or, in other words, such weaker writing in the image-erasing step ensures that the electrophoresis particles are in a less stationary state therein, resulting in full and sufficient agitation of the electrophoresis particles. Therefore, the preferred driving method of the electrophoresis display device according to the first aspect of the invention described above makes it possible to avoid the occurrence of any afterimage problem and thus offer enhanced image display quality.

The invention provides, as a second aspect thereof, an electrophoresis display device comprising: a pair of substrates that sandwich an electrophoresis element that contains, without any limitation thereto, a plurality of electrophoresis particles; a displaying section that is made up of a plurality of pixels; and a controlling section that controls the plurality of pixels, wherein the controlling section executes image-erasing operation through which an old image displayed on the displaying section is erased; and the image-erasing operation executed by the controlling section includes a first image-erasing operation in which a first gradation is displayed in each of the pixels of first areas whereas a second gradation is displayed in each of the pixels of second areas, where the pixels are grouped into the first areas and the second areas arrayed adjacent to each other in the displaying section, each of the first areas being made up of either a single pixel or plural pixels, each of the second areas being also made up of either a single pixel or plural pixels; and a second image-erasing operation in which the second gradation is displayed in each of the pixels of the first areas whereas the first gradation is displayed in each of the pixels of the second areas.

In the configuration of the electrophoresis display device according to the second aspect of the invention described above, the image-erasing operation is executed while displaying gradations that differ from each other in the first areas and the second areas in an alternate switchover manner. The pixels are grouped into the first areas and the second areas arrayed adjacent to each other in the displaying section of the electrophoresis display device, where each of the first areas is made up of either a single pixel or plural pixels whereas each of the second areas is also made up of either a single pixel or plural pixels. Accordingly, when the first image-erasing operation and the second image-erasing operation are executed in an alternate manner, the mixed color of the above-mentioned different gradations displayed in the first areas and the second areas in an alternate switchover manner is perceived by a user when viewed with the naked eye. Therefore, the invention provides, as an advantage of the second aspect thereof, an electrophoresis display device that makes it possible to significantly reduce flashing at the time of display-updating operation.

In the configuration of the electrophoresis display device according to the second aspect of the invention described above, it is preferable that the controlling section should execute the first image-erasing operation and the second image-erasing operation more than one time in an alternate manner.

With the preferred configuration of the electrophoresis display device according to the second aspect of the invention described above, it is possible to fully agitate the electrophoresis particles while effectively preventing or suppressing the occurrence of flashing. Thus, it is possible to improve image display quality while effectively preventing or suppressing a residual image.

In the configuration of the electrophoresis display device according to the second aspect of the invention described above, it is preferable that a plurality of data lines and a plurality of scanning lines that intersect with each other should be formed in the displaying section; each of the pixels should be formed at a position corresponding to the intersection of the data line and the scanning line; and the first areas and the second areas should be arrayed in a grid pattern along the extending direction of the data lines and the extending direction of the scanning lines.

With the preferred configuration of the electrophoresis display device according to the second aspect of the invention described above, it is possible to divide the displaying section into minute areas, that is, the first areas and the second areas arrayed in a grid pattern along the extending direction of the data lines and the extending direction of the scanning lines. For this reason, when the first image-erasing operation and the second image-erasing operation are executed in an alternate manner, the mixed color of the above-mentioned different gradations displayed in the first areas and the second areas in an alternate switchover manner is perceived by a user when viewed with the naked eye. Therefore, the preferred configuration of the electrophoresis display device according to the second aspect of the invention described above makes it possible to significantly reduce flashing at the time of display-updating operation.

In the preferred configuration of the electrophoresis display device according to the second aspect of the invention described above, it is further preferable that each of the first areas should be made up of not plural pixels but a single pixel and that each of the second areas should also be made up of not plural pixels but a single pixel.

With the preferred configuration of the electrophoresis display device according to the second aspect of the invention described above, it is possible to minimize the unit area size of the first areas and the second areas. For this reason, it is possible to make the difference in gradations that are displayed in the first areas and the second areas in an alternate switchover manner less perceivable when viewed with the naked eye. Therefore, the preferred configuration of the electrophoresis display device according to the second aspect of the invention described above makes it possible to significantly reduce flashing at the time of display-updating operation.

In the configuration of the electrophoresis display device according to the second aspect of the invention described above, it is preferable that a plurality of data lines and a plurality of scanning lines that intersect with each other should be formed in the displaying section; each of the pixels should be formed at a position corresponding to the intersection of the data line and the scanning line; each of the first areas should be elongated along the extending direction of the data lines; and each of the second areas should also be elongated along the extending direction of the data lines.

With the preferred configuration of the electrophoresis display device according to the second aspect of the invention described above, since it is possible to hold the electric potential of the data line at a certain level until display data has been inputted into every pixel in the first image-erasing operation and the second image-erasing operation, it is possible to reduce the burden of the control of the electric potential levels of the data lines therein.

In the configuration of the electrophoresis display device according to the second aspect of the invention described above, it is preferable that a plurality of data lines and a plurality of scanning lines that intersect with each other should be formed in the displaying section; each of the pixels should be formed at a position corresponding to the intersection of the data line and the scanning line; each of the first areas should be elongated along the extending direction of the scanning lines; and each of the second areas should also be elongated along the extending direction of the scanning lines.

With the preferred configuration of the electrophoresis display device according to the second aspect of the invention described above, it is possible to achieve a uniform electric potential for all data lines in the first image-erasing operation and the second image-erasing operation because the same single display data is inputted into all pixels of a certain row group that are connected to the same single scanning line. For this reason, it is possible to reduce the burden of the control of the electric potential levels of the data lines therein.

It is preferable that the electrophoresis display device according to the second aspect of the invention described above should further execute an image-writing operation through which an image is displayed in the displaying section, wherein a plurality of pixel electrodes is formed on one of the pair of substrates; a common electrode is formed on the other of the pair of substrates in such a manner that the common electrode is provided opposite to the plurality of pixel electrodes with the electrophoresis element being interposed therebetween; either a first electric potential or a second electric potential is inputted into some pixel electrodes in the first image-erasing operation; either the first electric potential or the second electric potential is inputted into some pixel electrodes in the second image-erasing operation; either the first electric potential or the second electric potential is inputted into some pixel electrodes in the image-writing operation; and a signal that causes the electric potential level of the common electrode to switch over between the first electric potential and the second electric potential in an alternate manner is inputted into the common electrode in each of the first image-erasing operation of the image-erasing operation, the second image-erasing operation of the image-erasing operation, and the image-writing operation.

With the preferred configuration of the electrophoresis display device according to the second aspect of the invention described above, it is possible to secure a time period during which there occurs a voltage level difference between the electric potential of the pixel electrode and the electric potential of the common electrode regardless of whether the first electric potential is inputted into the pixel electrode or the second electric potential is inputted into the pixel electrode. For this reason, the preferred configuration of the electrophoresis display device according to the second aspect of the invention described above makes it possible to rewrite/update the pixels having different gradations in a concurrent manner.

In the preferred configuration of the electrophoresis display device according to the second aspect of the invention described above, it is further preferable that each of the length of the time period of the first image-erasing operation and the length of the time period of the second image-erasing operation should be shorter than each of the length of the time period during which the electric potential level of the signal that is inputted into the common electrode in the image-writing operation in which an image is displayed in the displaying section is held at the first electric potential and the length of the time period during which the electric potential level of the signal that is inputted into the common electrode in the image-writing operation in which an image is displayed in the displaying section is held at the second electric potential.

In the preferred configuration of the electrophoresis display device according to the second aspect of the invention described above, each of the writing level of the first image-erasing operation and the writing level of the second image-erasing operation is relatively low (i.e., "weaker writing") in comparison with that of the image-writing operation. Because of the lesser writing intensity in the pixel-writing processing of the image-erasing operation, the electrophoresis particles do not move completely to the pixel electrode/common electrode when they migrate toward the pixel electrode/common electrode during the execution of the image-erasing operation. Or, in other words, such weaker writing in the image-erasing operation ensures that the electrophoresis particles are in a less stationary state therein, resulting in full and sufficient agitation of the electrophoresis particles. Therefore, the preferred configuration of the electrophoresis display device according to the second aspect of the invention described above makes it possible to avoid the occurrence of any afterimage problem and thus offer enhanced image display quality.

The invention provides, as a third aspect thereof, an electronic apparatus that is provided with the electrophoresis display device according to the second aspect of the invention described above. Therefore, the electronic apparatus according to the third aspect of the invention described above makes it possible to avoid the occurrence of any afterimage problem and thus offer enhanced image display quality. In addition, since the mixed color of the first gradation and the second gradation is perceived in the displaying section of the electrophoresis display device according to the second aspect of the invention, the electronic apparatus according to the third aspect of the invention described above, which is provided with the electrophoresis display device according to the second aspect of the invention, makes it possible to significantly reduce flashing at the time of display-updating operation.

BRIEF DESCRIPTION OF THE DRAWINGS

The invention will be described with reference to the accompanying drawings, wherein like numbers reference like elements.

FIG. 6A shows that the pixel 20 is in a white display state whereas FIG. 6B shows that the pixel 20 is in a black display state.

DESCRIPTION OF EXEMPLARY EMBODIMENTS

With reference to the accompanying drawings, an electrophoresis display device according to an exemplary embodiment of the invention is explained below. In the following description of exemplary embodiments of the invention, an electrophoresis display device that is driven in an active matrix scheme is taken as an example of various kinds of electrophoresis display devices according to an aspect the invention.

Needless to say, however, it should be understood that the specific exemplary embodiments described below are provided merely for the purpose of illustrating some modes of the invention, and therefore, never intended to limit the scope of the invention. Various arbitrary and/or discretionary modifications, alterations, changes, adaptations, improvements, or the like can be made on the explanation given herein without departing from the spirit and scope of the invention. It should be noted that, in each of the accompanying drawings that will be referred to in the following description of exemplary embodiment of the invention, the number, dimension and/or scale of components, units, members, and the like are modified from those that will be adopted in an actual implementation of the invention for the purpose of making them easily recognizable in each illustration.

Figure 1:
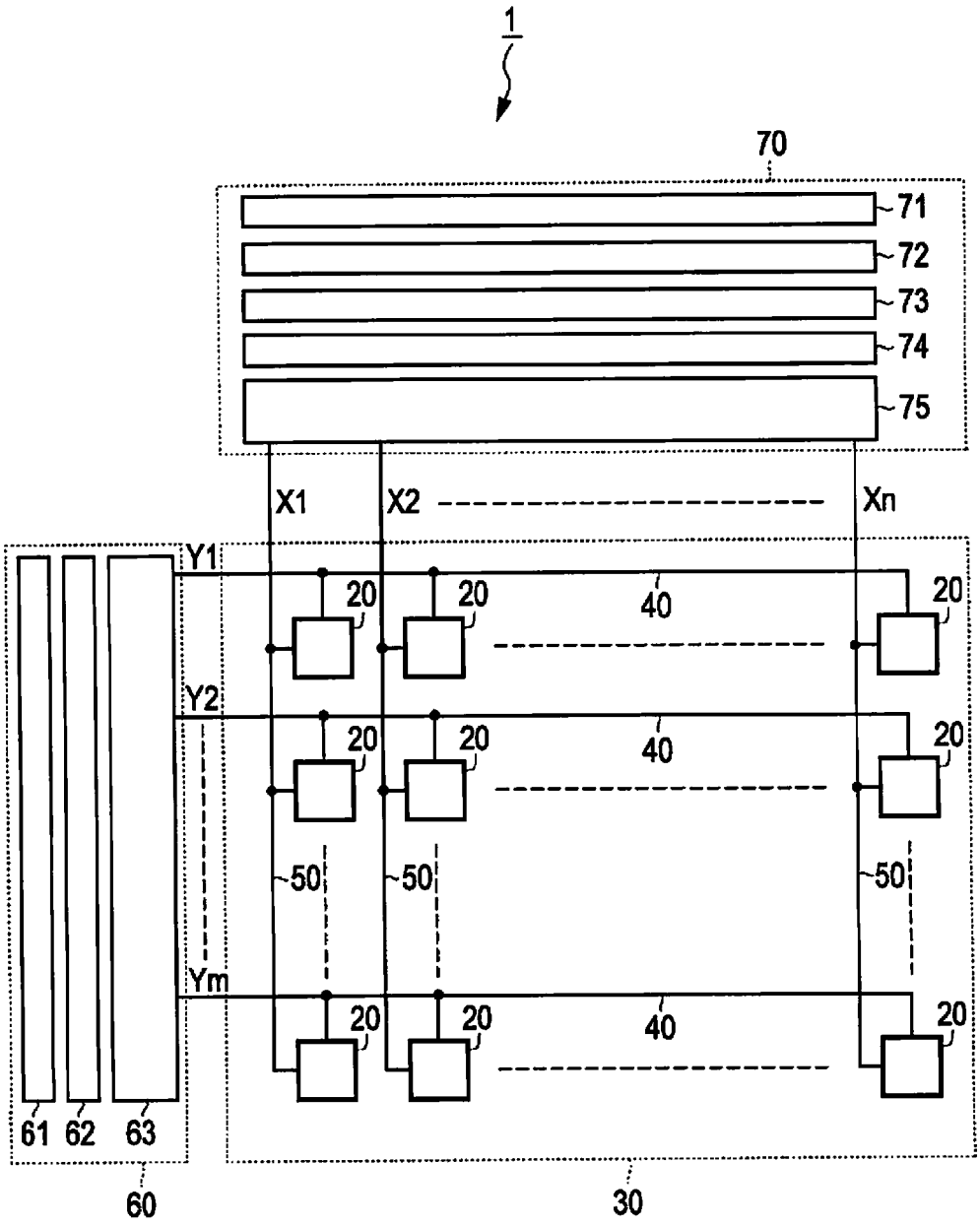
FIG. 1 is a general circuit diagram that schematically illustrates, in a plan view, an example of the electric configuration of an electrophoresis display device 1 according to an exemplary embodiment of the invention.

FIG. 1 is a general circuit diagram that schematically illustrates, in a plan view, an example of the electric configuration of an electrophoresis display device 1 according to an exemplary embodiment of the invention. The electrophoresis display device 1 is provided with, though not necessarily limited thereto, a display area (e.g., display unit or display portion, though not limited thereto) 30, a scanning line driving circuit 60, and a data line driving circuit 70. A combination of the scanning line driving circuit 60 and the data line driving circuit 70, though not necessarily limited thereto, constitutes a non-limiting example of a "controlling section" according to an aspect of the invention. A plurality of pixels 20 is formed on the display area 30. The pixels 20 are arranged in a matrix pattern thereon. In the matrix pattern, "n" pieces of the pixels 20 are arrayed along the extending direction of the data line driving circuit 70 (which is the X direction in the illustrated exemplary configuration of the electrophoresis display device 1 according to the present embodiment of the invention), whereas "m" pieces of the pixels 20 are arrayed along the extending direction of the scanning line driving circuit 60 (which is the Y direction in the illustrated exemplary configuration of the electrophoresis display device 1 according to the present embodiment of the invention). The scanning line driving circuit 60 is connected to the pixels 20 via a plurality of scanning lines 40 (Y1, Y2, . . . , Ym). Each of the scanning lines 40 extends in the above-mentioned extending direction of the data line driving circuit 70 on the display area 30 (i.e., X direction). The data line driving circuit 70 is connected to the pixels 20 via a plurality of data lines 50 (X1, X2, . . . , Xn). Each of the data lines 50 extends in the above-mentioned extending direction of the scanning line driving circuit 60 on the display area 30 (i.e., Y direction).

The scanning line driving circuit 60 is provided with a shift register circuit 61, a level shifter 62, and an output buffer 63. The shift register circuit 61 is provided with a plurality of flip-flop circuits. Each of the flip-flop circuits is provided for the corresponding one of the plurality of scanning lines 40. Note that these flip-flop circuits are not illustrated in the accompanying drawings. These flip-flop circuits are connected in series.

The scanning line driving circuit 60 that has circuit components/units explained above operates as follows. With a clock pulse being inputted in the shift register circuit 61 of the scanning line driving circuit 60, a start pulse is inputted therein. The inputted start pulse flows through one flip-flop circuit after another in synchronization with the rising edge of the clock pulse, that is, clock pulse rise time, and the falling edge of the clock pulse, that is, clock pulse fall time. At the clock pulse rise time, an electric potential goes up from a low level to a high level. At the clock pulse fall time, an electric potential goes down from a high level to a low level. Upon reception of the start pulse, the flip-flop circuit supplies a selection signal to the level shifter 62.

The level shifter 62 is a circuit that changes the electric potential level of a selection signal. The level shifter 62 is provided because each pixel 20 requires an electric potential that is higher in a level than that is required by the scanning line driving circuit 60. After being subjected to electric-potential level conversion at the level shifter 62, the selection signal enters the output buffer 63. The output buffer 63 performs electric-current amplification on the inputted selection signal. After being subjected to electric-current amplification at the output buffer 63, the selection signal is supplied to the scanning lines 40. Since the scanning line driving circuit 60 is provided with the output buffer 63, it is possible to supply a driving force to any distant pixel 20 that is located at a remote position away from the scanning line driving circuit 60.

The data line driving circuit 70 is provided with a shift register circuit 71, a first latch circuit 72, a second latch circuit 73, a level shifter 74, and an output buffer 75.

The data line driving circuit 70 that has circuit components/units explained above operates as follows. With a clock pulse being inputted in the shift register circuit 71 of data line driving circuit 70, a start pulse is inputted therein. Upon reception of the start pulse, the shift register circuit 71 sends a latch signal to the first latch circuit 72 in the sequential order of the data lines 50, that is, from X1 to Xn. The first latch circuit 72 is provided with a plurality of memory units each of which stores an image data signal for the corresponding one of data line 50. Having such a line-by-line data storage circuit configuration, which is not illustrated in the drawing, the first latch circuit 72 acquires and then stores the image data signal in synchronization with the latch signal. After the first latch circuit 72 has completed the acquisition/storage of image data into the memory units thereof, all of the acquired/stored image data are sent to the second latch circuit 73 concurrently. As in the above-described circuit configuration of the first latch circuit 72, the second latch circuit 73 is provided with a plurality of memory units each of which stores an image data signal for the corresponding one of data line 50. Having such a line-by-line data storage circuit configuration, which is not illustrated in the drawing, the second latch circuit 73 stores image data that is sent from the first latch circuit 72.

The image data stored in the second latch circuit 73 is sent to the level shifter 74. The level shifter 74 changes the electric potential level of the received image data signals. After being subjected to electric-current amplification at the output buffer 75, the image data signals are supplied to the data lines 50. The image data signals that are supplied to the data lines 50 are then inputted into a certain row group of pixels 20 that are connected to the same single scanning line 40 to which the aforementioned selection signal is now being supplied from the aforementioned scanning line driving circuit 60.

In the operation of the data line driving circuit 70 explained above, upon the supplying of an image data signal from the first latch circuit 72 to the second latch circuit 73, another image data signal that is to be supplied to the next row group of pixels 20 that are connected to the next scanning line 40 is taken into the first latch circuit 72. By this means, it is possible to input image data into the data lines 50 in a consecutive manner.

Figure 2:
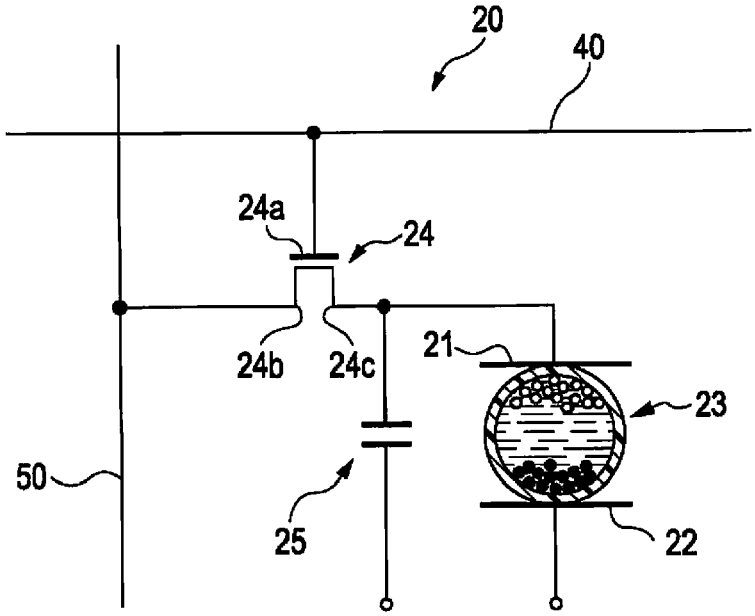
FIG. 2 is a circuit diagram that schematically illustrates an example of the configuration of one of a plurality of pixels 20.

FIG. 2 is a circuit diagram that schematically illustrates an example of the configuration of one of the pixels 20. The pixel 20 is made up of, though not necessarily limited thereto, a switching element (i.e., switching device) 24, a capacitor 25, a pixel electrode 21, a common electrode 22, and an electrophoresis element (i.e., electrophoresis device) 23.

In the pixel configuration of the electrophoresis display device 1 according to the present embodiment of the invention, the switching element 24 is formed as a field-effect n-channel transistor (i.e., n-channel FET). The scanning line 40 is electrically connected to the gate terminal 24*a* of the field-effect n-channel transistor 24. The data line 50 is electrically connected to the source terminal 24*b* of the field-effect n-channel transistor 24. The capacitor 25 and the pixel electrode 21 are electrically connected to the terminal opposite to the source terminal 24*b*, that is, the drain terminal of the field-effect n-channel transistor 24. The electrophoresis element(s) 23 is sandwiched between the pixel electrode 21 and the common electrode 22.

The capacitor 25 is electrically charged during a switching-element operation period in which the field-effect n-channel transistor 24 is active, that is, in an ON state. The capacitor 25 holds/retains an electric potential for a certain time period after the operation of the field-effect n-channel transistor 24 has been suspended. Therefore, the capacitor 25 is capable of supplying the held/retained electric potential to the pixel electrode 21 for a certain time period after the field-effect n-channel transistor 24 was put into an OFF state.

Figure 3:
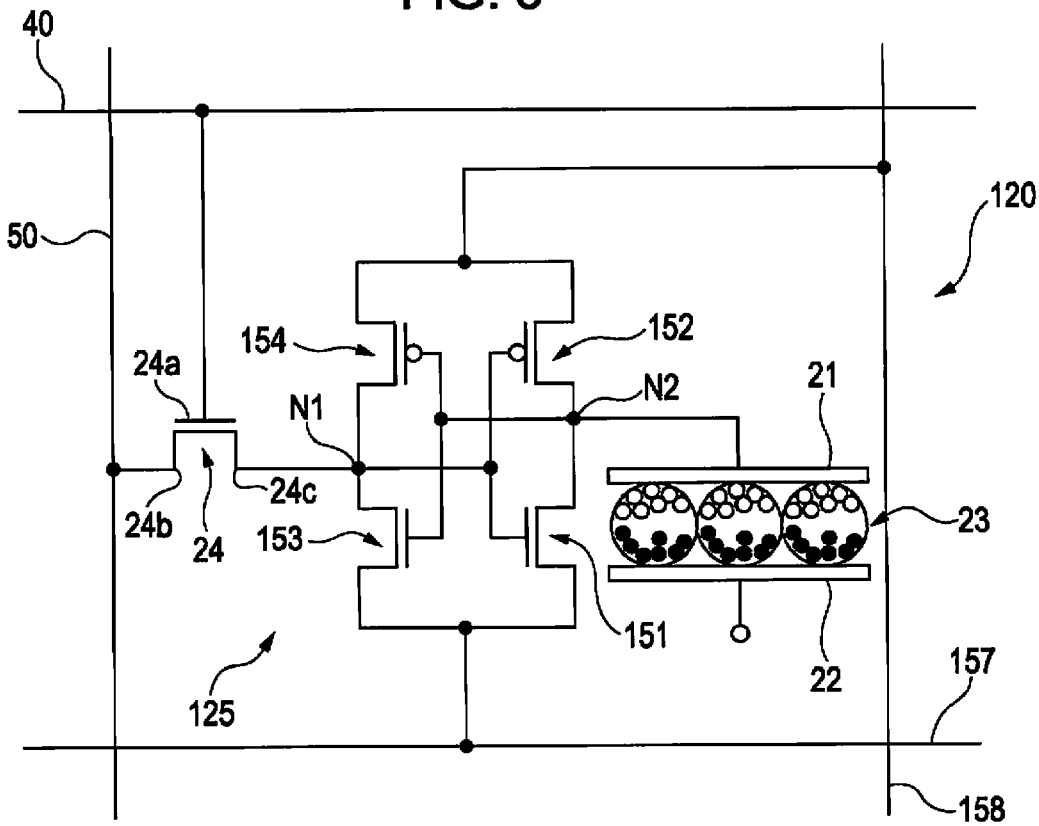
FIG. 3 is a circuit diagram that schematically illustrates an example of the configuration of one of a plurality of pixels 120 that is provided with a latch circuit 125.

In the pixel configuration of the electrophoresis display device 1 according to the present embodiment of the invention, it is possible to adopt a latch circuit as a substitute for the capacitor 25. In the following description, the modified pixel configuration of the electrophoresis display device 1 according to the present embodiment of the invention that is provided with a latch circuit in substitution for the capacitor 25 is explained while making reference to FIG. 3. FIG. 3 is a circuit diagram that schematically illustrates an example of the configuration of one of pixels 120 that is provided with a latch circuit 125. The pixel 120 has the following circuit configuration. The latch circuit 125 is provided between the switching element 24 and the pixel electrode 21. The input terminal N1 of the latch circuit 125 is electrically connected to the drain terminal 24*c* of the switching element 24. The output terminal N2 of the latch circuit 125 is electrically connected to the pixel electrode 21.

The latch circuit 125 is formed as a combination of one inverter circuit that is made up of a p-channel transistor 154 and an n-channel transistor 153 and another inverter circuit that is made up of a p-channel transistor 152 and an n-channel transistor 151. In the circuit configuration of the latch circuit 125, the p-channel transistor 154 and the n-channel transistor 153 are electrically connected to each other at the input terminal N1. In addition, the p-channel transistor 152 and the n-channel transistor 151 are electrically connected to each other at the output terminal N2. Each of the gate terminal of the p-channel transistor 154 and the gate terminal of the n-channel transistor 153 is electrically connected to the output terminal N2 and further to the pixel electrode 21. On the other hand, each of the gate terminal of the p-channel transistor 152 and the gate terminal of the n-channel transistor 151 is electrically connected to the input terminal N1 and further to the switching element 24. Each of the p-channel transistors 152 and 154 is electrically connected to a high electric-potential power line 158. On the other hand, each of the n-channel transistors 151 and 153 is electrically connected to a low electric-potential power line 157.

A non-limiting example of the latch circuit 125 having a circuit configuration explained above is an SRAM, which is the acronym of Static Random Access Memory. At the time when the input terminal N1 of the latch circuit 125 is at a high electric potential, the output terminal N2 thereof is at a low electric potential. At the time when the input terminal N1 of the latch circuit 125 is at a low electric potential, the output terminal N2 thereof is at a high electric potential. Image data that is inputted in the latch circuit 125 is held/retained until the power of the latch circuit 125 is turned OFF. Therefore, it is possible to input a stable electric potential into the pixel electrode 21.

Figure 4:
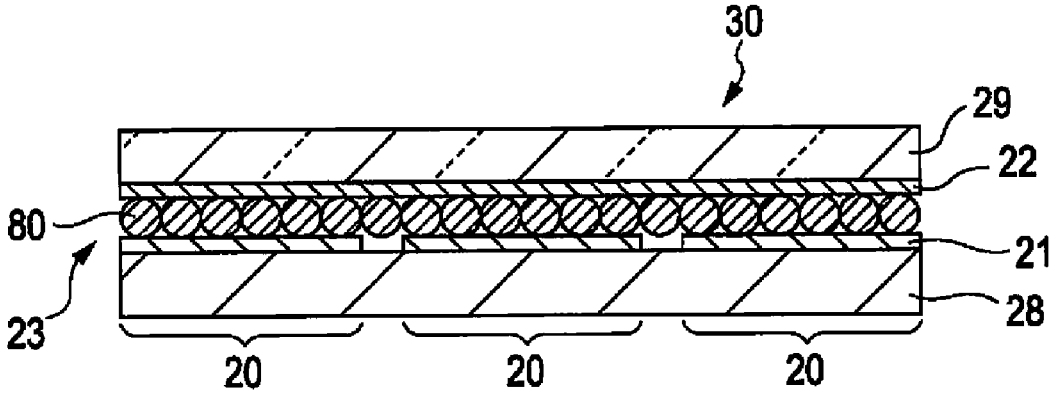
FIG. 4 is a partial sectional view that schematically illustrates an example of the partial configuration of the display unit/area 30 of the electrophoresis display device 1 according to an exemplary embodiment of the invention.

FIG. 4 is a partial sectional view that schematically illustrates an example of the partial configuration of the aforementioned display unit (e.g., display area or display portion, though not limited thereto) 30 of the electrophoresis display device 1 according to the present embodiment of the invention. In the configuration of the display unit 30 of the electrophoresis display device 1 according to the present embodiment of the invention, the electrophoresis element(s) 23 is sandwiched between an element substrate 28 and a counter substrate (i.e., opposite substrate) 29. The element substrate 28 has the pixel electrodes 21, whereas the counter substrate 29 has the common electrode 22. The electrophoresis element 23 is made up of a plurality of microcapsules 80.

The pixel electrodes 21, each of which is provided for the corresponding one of the pixels 20, are formed on the element substrate 28. The pixel electrodes 21 are made of an electroconductive material (i.e., electrically conductive material) such as aluminum (Al), indium tin oxide (ITO), and the like, without any limitation thereto. The element substrate 28 is a molded substrate that is made of glass or plastic, though not limited thereto. The scanning line 40, the data line 50, the switching element 25, the capacitor 25, and the like that are illustrated in FIG. 1/FIG. 2 are formed between the pixel electrode 21 and the element substrate 28 in each pixel of the electrophoresis display device 1 according to the present embodiment of the invention. Note that these pixel components are not illustrated in FIG. 4. The counter substrate 29 is provided at the image-display side of the electrophoresis display device 1 according to the present embodiment of the invention. The counter substrate 29 is a transparent substrate that is made of, for example, glass or plastic, though not limited thereto. The common electrode 22 is formed on the inner surface of the counter substrate 29, or, in other words, one surface thereof closer to the electrophoresis element 23 than the other. The common electrode 22 is formed on the substantially entire electrophoresis-element-side surface of the counter substrate 29. The common electrode 22 is made of a material that has both optical transparency and electric conductivity. As a non-limiting example of such a transparent and conductive material, the common electrode 22 is made of magnesium silver (MgAg), indium tin oxide (ITO), or indium zinc oxide (IZO).

Figure 5:
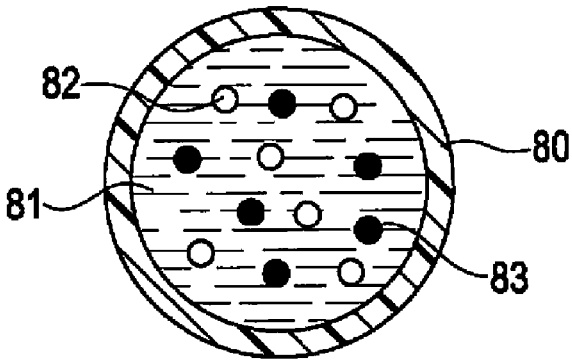
FIG. 5 is a diagram that schematically illustrates, in a sectional view, an example of the configuration of a microcapsule 80.

FIG. 5 is a diagram that schematically illustrates, in a sectional view, an example of the configuration of the microcapsule 80. The microcapsule 80 is formed as a minute capsule that has a diameter of, for example, approximately 50 μm. The microcapsule 80 is a globular or spherical capsule inside which a dispersion medium 81, a plurality of white particles 82, and a plurality of black particles 83 are sealed. The plurality of white particles 82 is an example of one component of electrophoresis particles. The plurality of black particles 83 is an example of the other component of electrophoresis particles. The outer (i.e., capsule) portion of the microcapsule 80 is made of, for example, an acrylic resin including but not limited to polymethyl methacrylate or polyethyl methacrylate, a urea resin, or a polymeric resin having optical transparency such as gum arabic or the like. As illustrated in the sectional view of FIG. 4, the microcapsules 80 are sandwiched between the pixel electrodes 21 and the common electrode 22. Either one or more microcapsule 80 is provided in each pixel 20 of the display unit 30 of the electrophoresis display device 1 according to the present embodiment of the invention.

The dispersion medium 81 is a liquid, the presence of which enables the white particles 82 and the black particles 83 to be dispersed inside the microcapsule 80. The dispersion medium 81 can be formed as a compound of a surfactant (i.e., surface-active agent) and either a single chemical element/material/substance or combined chemical elements/materials/substances that is/are selected from, without any intention to limit thereto: water, alcohol solvent such as methanol, ethanol, isopropanol, butanol, octanol, methyl cellosolve or the like, ester kinds such as ethyl acetate, butyl acetate or the like, ketone kinds such as acetone, methyl ethyl ketone, methyl isobutyl ketone or the like, aliphatic hydrocarbon such as pentane, hexane, octane or the like, alicyclic hydrocarbon such as cyclohexane, methylcyclohexane or the like, aromatic hydrocarbon such as benzene kinds having a long-chain alkyl group such as benzene, toluene, xylene, hexyl benzene, butyl benzene, octyl benzene, nonyl benzene, decyl benzene, undecyl benzene, dodecyl benzene, tridecyl benzene, tetradecyl benzene or the like, halogenated hydrocarbon such as methylene chloride, chloroform, carbon tetrachloride, 1,2-dichloroethane or the like, carboxylate, or any other kind of oil and fat. It should be noted that the material of the dispersion medium 81 is not limited to those enumerated above.

The white particle 82 is constituted as, for example, a particle (i.e., high polymer or colloid) made of white pigment such as titanium dioxide, hydrozincite, antimony trioxide or the like. In the present embodiment of the invention, the white particle 82 is charged negatively though not limited thereto. On the other hand, the black particle 83 is constituted as, for example, a particle (i.e., high polymer or colloid) made of black pigment such as aniline black, carbon black or the like. In the present embodiment of the invention, the black particle 83 is charged positively though not limited thereto.

If necessary, a charge-controlling agent, a dispersing agent, a lubricant, a stabilizing agent, or the like, may be added to the above-mentioned pigments that make up these electrophoresis particles. The charge-controlling agent may be made of particles of, for example, electrolyte, surface-active agent, metallic soap, resin, gum, oil, varnish, or compound, though not limited thereto. The dispersing agent may be a titanium-system coupling agent, an aluminum-system coupling agent, a silane-system coupling agent, though not limited thereto.

Figure 6A:
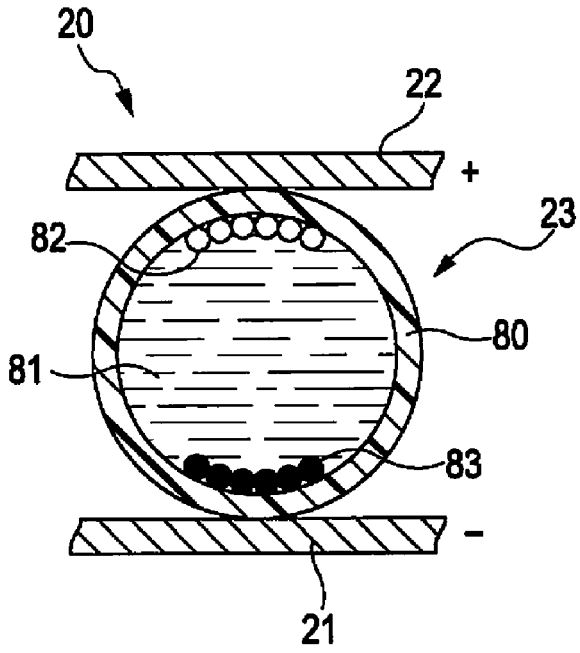
FIGS. 6A and 6B is a set of diagrams that schematically illustrates an example of the operation of the microcapsule 80; or more specifically.
Figure 6B:
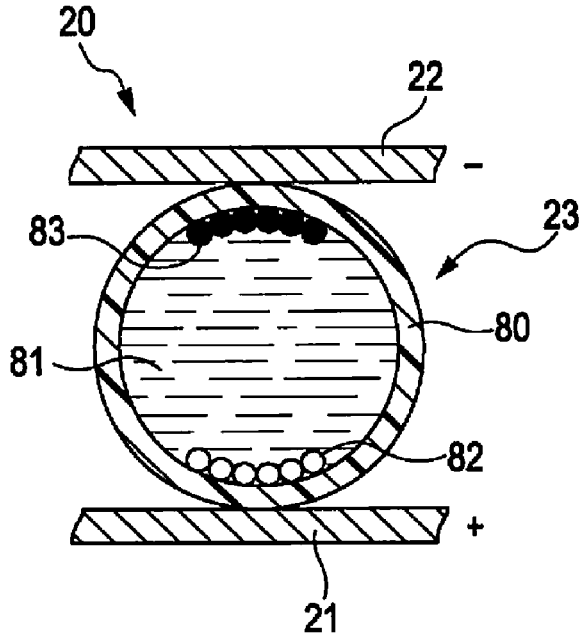

FIGS. 6A and 6B is a set of diagrams that schematically illustrates an example of the operation of the microcapsule 80; or more specifically, FIG. 6A shows that the pixel 20 is in a white display state whereas FIG. 6B shows that the pixel 20 is in a black display state. When a voltage is applied in such a manner that the voltage level (i.e., electric potential) of the common electrode 22 is relatively high in comparison with that of the pixel electrode 21, as illustrated in FIG. 6A, the white particles 82, which are negatively charged, are drawn to the common electrode 22 inside the microcapsule 80 whereas the black particles 83, which are positively charged, are drawn to the pixel electrode 21 inside the microcapsule 80. As a result thereof, this pixel 20 is put into a white display state.

When a voltage is applied in such a manner that the voltage level (i.e., electric potential) of the pixel electrode 21 is relatively high in comparison with that of the common electrode 22, as illustrated in FIG. 6B, the black particles 83, which are positively charged, are drawn to the common electrode 22 inside the microcapsule 80 whereas the white particles 82, which are negatively charged, are drawn to the pixel electrode 21 inside the microcapsule 80. As a result thereof, this pixel 20 is put into a black display state.

The pigments used for the white particles 82 and the black particles 83 described above may be replaced by, for example, red, green, and blue one, though not limited thereto. If so modified, the electrophoresis display device 1 can display, for example, red, green, and blue.

First Method for Driving Electrophoresis Display Device

Next, with reference to the accompanying drawings, a method for driving an electrophoresis display device according to exemplary embodiments of the invention is explained. In the description of this specification as well as in the recitation of appended claims, the phrase "a method for driving an electrophoresis display device" includes the meaning of, in addition to its literal meaning, "a driving method that is used by an electrophoresis display device" and "a driving method of an electrophoresis display device", without any limitation thereto. In a brief non-limiting summary, a first method for driving an electrophoresis display device according to the present embodiment of the invention has the following features. Each one of a plurality of pixels that are arrayed in a grid matrix pattern is taken as the minimum unit of minute areas (which correspond to "first areas"/"second areas" according to an aspect of the invention) that perform white erasure and black erasure. White display and black display are provided in a checkered array pattern. The white display and the black display are switched over in such an alternate manner for image erasure that it might be perceived as if the checkered pattern "moves" from left to right on the image display unit of an electrophoresis display device according to the present embodiment of the invention. In the following description, the image display unit may be simply referred to as "display unit" or may be reworded as "display area" as long as the context allows without any intention to limit the technical scope of the invention. The "display unit" and "display area" is a non-limiting example of a "displaying section" of an electrophoresis display device according to an aspect of the invention. A more detailed explanation of the features of the first method for driving an electrophoresis display device according to the present embodiment of the invention is given below.

Figure 7:
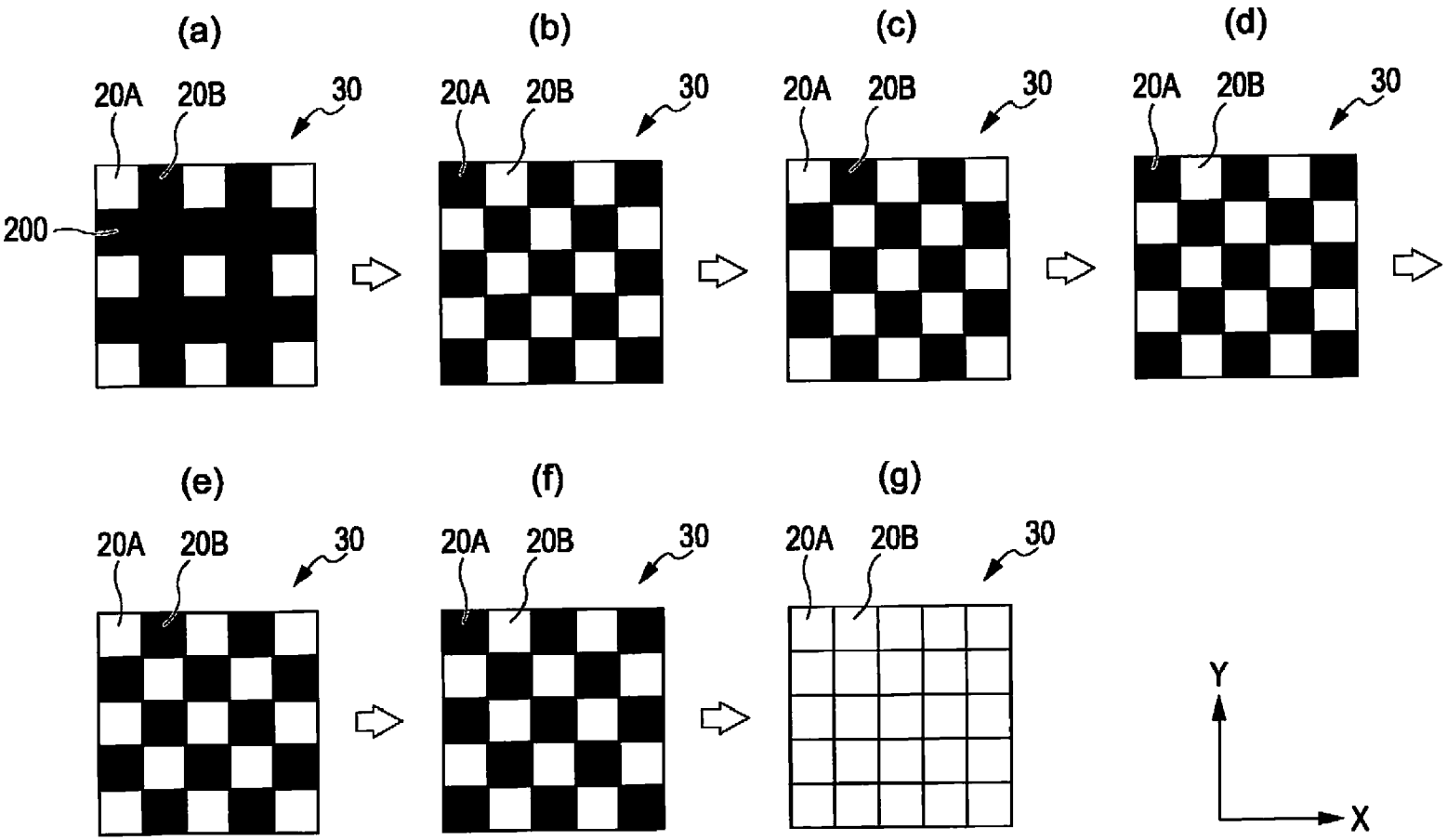
FIG. 7 is a display-state transition diagram that schematically illustrates an example of the image pattern of the display unit/area 30 of the electrophoresis display device 1 where such a display-state transition occurs in an image-erasing step of a first method for driving the electrophoresis display device 1 according to an exemplary embodiment of the invention.
Figure 8:
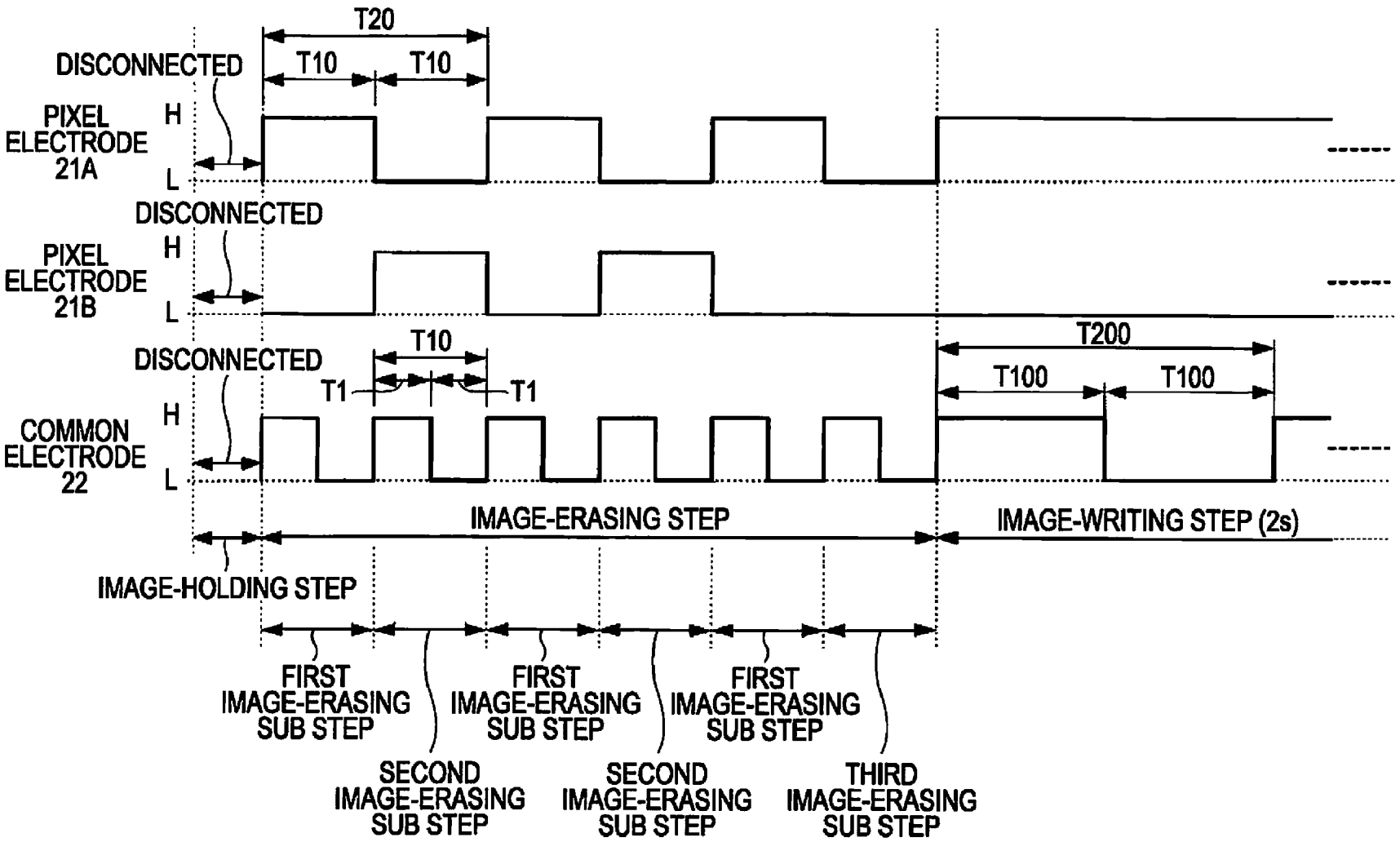
FIG. 8 is a timing chart that schematically illustrates an example of the timing operation of the first method for driving the electrophoresis display device 1 according to an exemplary embodiment of the invention.
Figure 9A:
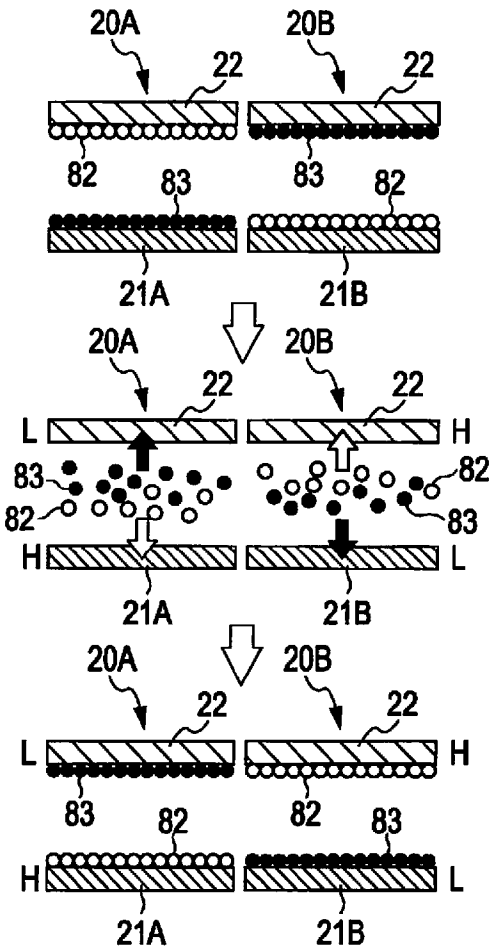
FIGS. 9A, 9B, and 9C is a set of diagrams that schematically illustrates an example of the migration behavior of electrophoresis particles in the image-erasing step of the first method for driving the electrophoresis display device 1 according to an exemplary embodiment of the invention.
Figure 9B:
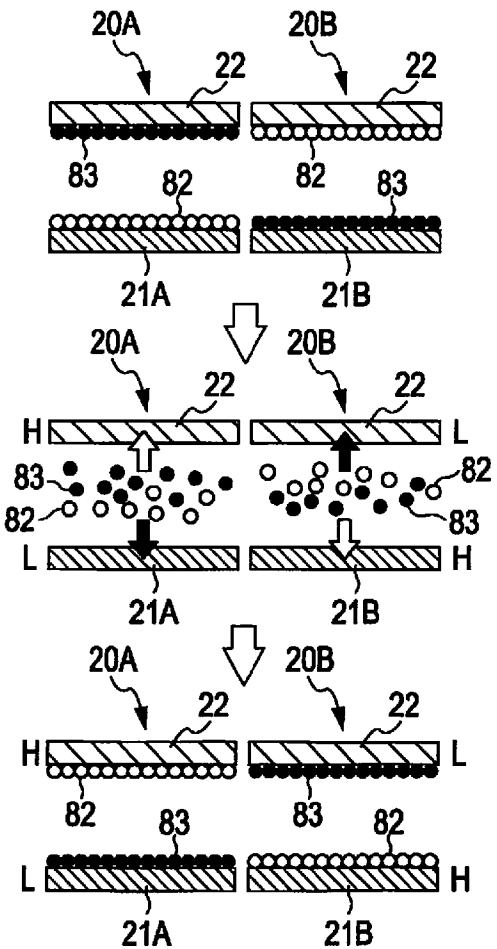
Figure 9C:
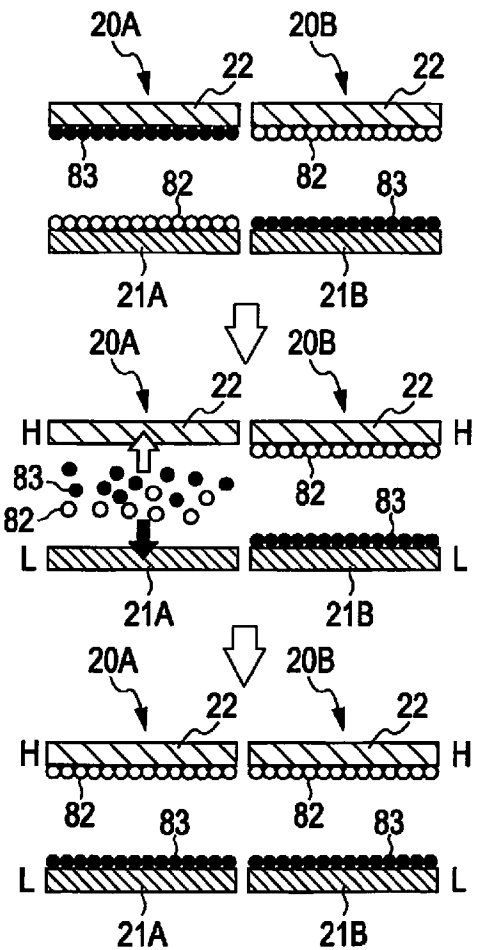

FIG. 7 is a display-state transition diagram that schematically illustrates an example of the image pattern of a display unit 30 of an electrophoresis display device according to the first exemplary embodiment of the invention where such a display-state transition occurs at the time of image-erasing operation thereof. In the process of image-erasing operation of the first method for driving an electrophoresis display device according to the present embodiment of the invention, an image 200, which has the shape of a lattice (a right-angled sharp sign #) as shown in the initial display state (a) of FIG. 7, is erased through a series of alternate and repetitive switchovers of checkered black-and-white display. In the following description, the phrase "alternate and repetitive" may be simply referred to as "alternate" because the word "alternate" includes connotation of repetition. The term "repetition" or "repetitive" used in the following description is not intended to limit the technical scope of the invention. It should be noted that FIG. 7 illustrates an arbitrary 5×5 matrix portion of the entire display area 30 of an electrophoresis display device according to an exemplary embodiment of the invention. Therefore, FIG. 7 shows the total twenty-five (25) pixels 20 that are arrayed in a matrix pattern made up of five rows each of which extends along the scanning line 40 (i.e., in the X direction) and five columns each of which extends along the data line 50 (i.e., in the Y direction). In the 5×5 matrix diagram of FIG. 7, the uppermost and leftmost pixel is denoted as 20A. The uppermost pixel in the second column from the left, which is adjacent to the uppermost and leftmost pixel 20A, is denoted as 20B. The pair of these pixels 20A and 20B is arbitrarily selected out of the checkered black-and-white array pattern of the display unit 30 as two pixels arrayed adjacent to each other, one of which is in a white display state and the other of which is in a black display state that alternate with each other at each moment of operation. There is no other specific reason (i.e., intention or meaning) for the selection of these pixels 20A and 20B. In the following description of the first method for driving an electrophoresis display device according to the present embodiment of the invention, our attention is directed to the display-state transition of these pixels 20A and 20B. FIG. 8 is a timing chart that schematically illustrates an example of the timing operation of the first method for driving an electrophoresis display device according to the present embodiment of the invention. In the first method for driving an electrophoresis display device according to the present embodiment of the invention, an image-holding step, an image-erasing step, and an image-writing step are executed. FIG. 8 shows the waveform of a voltage that is inputted into the pixel electrode 21A of the pixel 20A, the waveform of a voltage that is inputted into the pixel electrode 21B of the pixel 20B, and the waveform of a voltage that is inputted into the common electrode 22, which is common to the pixels 20A and 20B. The sectional view of each of the pixel electrode 21A of the pixel 20A, the pixel electrode 21B of the pixel 20B, and the common electrode 22 is shown in each of FIGS. 9A, 9B, and 9C. FIGS. 9A, 9B, and 9C is a set of diagrams that schematically illustrates an example of the migration behavior, for example, movement, of electrophoresis particles in the image-erasing step of the first method for driving an electrophoresis display device according to the present embodiment of the invention. FIG. 9A corresponds to the migration behavior of electrophoresis particles in the pixels 20A and 20B in a first image-erasing sub step of the image-erasing step mentioned above. FIG. 9B corresponds to the migration behavior of electrophoresis particles in the pixels 20A and 20B in a second image-erasing sub step of the image-erasing step mentioned above. FIG. 9C corresponds to the migration behavior of electrophoresis particles in the pixels 20A and 20B in a third image-erasing sub step of the image-erasing step mentioned above.

First of all, the image-holding step is explained below. The image-holding step corresponds to a time period during which an image that is written into the display unit 30 is being held. In the image-holding step, the pixel electrode 21A of the pixel 20A, the pixel electrode 21B of the pixel 20B, and the common electrode 22 are in an electrically disconnected high impedance state.

Next, the image-erasing step is explained below. The image-erasing step corresponds to a time period during which the entire display area of the display unit 30 goes through black-and-white display-state transition in an alternate manner for the purpose of erasing an old image prior to the writing of a new image in the display area 30. More specifically, in the image-erasing step of the first method for driving an electrophoresis display device according to the present embodiment of the invention, the entire display area of the display unit 30 goes through black-and-white display-state transition in a checkered pattern and in an alternate manner for the purpose of erasing an old image prior to the writing of a new image in the display area 30. The image-erasing step consists of the first image-erasing sub step(s), the second image-erasing sub step(s), and the third image-erasing sub step.

Upon the transition of the first method for driving an electrophoresis display device according to the present embodiment of the invention from the image-holding step into the image-erasing step, a pulse signal having a rectangular waveform is supplied to the common electrode 22. Because of the input of such a rectangular pulse signal, the electric potential of the common electrode 22 switches over between a high electric-potential level H and a low electric-potential level L in an alternate manner. In the timing chart of FIG. 8 as well as in the following description, each of the high-voltage time period during which the electric potential of the common electrode 22 is at a high level H in the image-erasing step and the low-voltage time period during which the electric potential of the common electrode 22 is at a low level L in the image-erasing step is denoted as T1. A set of one common-electrode high-level time period T1 and one common-electrode low-level time period T1 in the image-erasing step is equal to one cycle of the rectangular pulse signal applied to the common electrode 22 therein. A low electric potential L is inputted into the pixel electrode 21 of each of the pixels 20 whose operation state are to be transitioned into a white display state, whereas a high electric potential H is inputted into the pixel electrode 21 of each of the pixels 20 whose operation state are to be transitioned into a black display state. As a result of the supplying of a low electric potential L to the pixel electrode 21 of each of the pixels 20 whose operation state are to be transitioned into a white display state and the supplying of a high electric potential H to the pixel electrode 21 of each of the pixels 20 whose operation state are to be transitioned into a black display state, a potential electric difference is generated between the pixel electrode 21 of each of the pixels 20 whose operation state are to be transitioned into a white display state and the common electrode 22 during a time period in which a high electric potential H is supplied to the common electrode 22. Because of the electric potential difference generated therebetween and the resultant migration of electrophoresis elements, the operation state of each of the above-mentioned "to-be-white-displayed" pixels 20 transitions into a white display state. On the other hand, as a result of the supplying of a low electric potential L to the pixel electrode 21 of each of the pixels 20 whose operation state are to be transitioned into a white display state and the supplying of a high electric potential H to the pixel electrode 21 of each of the pixels 20 whose operation state are to be transitioned into a black display state, a potential electric difference is generated between the pixel electrode 21 of each of the pixels 20 whose operation state are to be transitioned into a black display state and the common electrode 22 during a time period in which a low electric potential H is supplied to the common electrode 22. Because of the electric potential difference generated therebetween and the resultant migration of electrophoresis elements, the operation state of each of the above-mentioned "to-be-black-displayed" pixels 20 transitions into a black display state. Therefore, through the inputting of a rectangular pulse signal into the common electrode 22, which causes the electric potential of the common electrode 22 to switch over between a high electric-potential level H and a low electric-potential level L in an alternate manner, it is possible to achieve black-and-white display on the plurality of pixels 20 in a concurrent manner where some pixels 20 are in a white display state whereas other pixels 20 are in a black display state, which alternate with each other. A driving method that achieves such concurrent and alternate black-and-white display is called as, or can be named as, a "pulsed common-electrode electric-potential level switchover drive scheme". In the following description of the first method for driving an electrophoresis display device according to the present embodiment of the invention, it is assumed that the pulsed common-electrode electric-potential level switchover drive scheme named above is adopted, although it does not restrict the technical scope of the invention. In the following description, the pulsed common-electrode electric-potential level switchover drive scheme named above may be simply referred to as a "pulsed common switchover scheme".

First of all, an explanation is given below of the first image-erasing sub step of the image-erasing step. The time period T10 of the first image-erasing sub step corresponds to one cycle of a pulse signal that is supplied to the common electrode 22. Throughout the time period T10 of the first image-erasing sub step, a high electric potential H is applied to the pixel electrode 21A of the pixel 20A. During the first half of the time period T10 of the first image-erasing sub step throughout which a high electric potential H is applied to the common electrode 22, there occurs no voltage level difference between the electric potential (H) of the pixel electrode 21A of the pixel 20A and the electric potential (H) of the common electrode 22. For this reason, the white particles 82 and the black particles 83 do not migrate in the pixel 20A during the first half of the time period T10 of the first image-erasing sub step. During the second half of the time period T10 of the first image-erasing sub step throughout which a low electric potential L is applied to the common electrode 22, there occurs a voltage level difference between the electric potential (H) of the pixel electrode 21A of the pixel 20A and the electric potential (L) of the common electrode 22. Since the electric potential of the pixel electrode 21A of the pixel 20A is higher than the electric potential of the common electrode 22 throughout the second half of the time period T10 of the first image-erasing sub step, the black particles 83 are drawn to, and gather at, the common electrode 22 whereas the white particles 82 are drawn to, and gather at, the pixel electrode 21A of the pixel 20A. The migration behavior of the white particles 82 and the black particles 83 explained above is illustrated in FIG. 9A. As a result thereof, the operation state of the pixel 20A, which was in a white display state at its initial status, transitions into a black display state. Throughout the time period T10 of the first image-erasing sub step, a low electric potential L is applied to the pixel electrode 21B of the pixel 20B. During the same time period T10 of the first image-erasing sub step, one cycle of a pulse signal is inputted into the common electrode 22. Accordingly, during the first half of the time period T10 of the first image-erasing sub step throughout which a high electric potential H is applied to the common electrode 22, there occurs a voltage level difference between the electric potential (L) of the pixel electrode 21B of the pixel 20B and the electric potential (H) of the common electrode 22. Since the electric potential of the pixel electrode 21B of the pixel 20B is lower than the electric potential of the common electrode 22 throughout the first half of the time period T10 of the first image-erasing sub step, the white particles 82 are drawn to, and gather at, the common electrode 22 whereas the black particles 83 are drawn to, and gather at, the pixel electrode 21B of the pixel 20B. The migration behavior of the white particles 82 and the black particles 83 explained above is illustrated in FIG. 9A. During the second half of the time period T10 of the first image-erasing sub step throughout which a low electric potential L is applied to the common electrode 22, there occurs no voltage level difference between the electric potential (L) of the pixel electrode 21B of the pixel 20B and the electric potential (L) of the common electrode 22. For this reason, the white particles 82 and the black particles 83 do not migrate in the pixel 20B during the second half of the time period T10 of the first image-erasing sub step. As a result of the movement behavior of the white particles 82 and the black particles 83 during the entire time period T10 of the first image-erasing sub step explained above, the operation state of the pixel 20B, which was in a black display state at its initial status, transitions into a white display state. Consequently, the image (200) displayed on the display unit 30 transitions from the initial display state (a) of FIG. 7 into the next display state (b) thereof. During the transition process, the white particles 82 and the black particles 83 are agitated in each pixel 20 whose display state is reversed. Since very small black areas and very small white areas are arranged in an alternate array pattern in the display unit 30, or more specifically, in a checkered pattern in the illustrated exemplary configuration of an electrophoresis display device according to the present embodiment of the invention, they are always perceived by a user as the mixed color of gray when viewed with the naked eye. For this reason, the aforementioned image problem of flashing does not arise, which is comfortable to users.

Next, an explanation is given below of the second image-erasing sub step of the image-erasing step. The time period T10 of the second image-erasing sub step corresponds to one cycle of a pulse signal that is supplied to the common electrode 22. Throughout the time period T10 of the second image-erasing sub step, a low electric potential L is applied to the pixel electrode 21A of the pixel 20A. During the first half of the time period T10 of the second image-erasing sub step throughout which a high electric potential H is applied to the common electrode 22, there occurs a voltage level difference between the electric potential (L) of the pixel electrode 21A of the pixel 20A and the electric potential (H) of the common electrode 22. Since the electric potential of the pixel electrode 21A of the pixel 20A is lower than the electric potential of the common electrode 22 throughout the first half of the time period T10 of the second image-erasing sub step, the white particles 82 are drawn to, and gather at, the common electrode 22 whereas the black particles 83 are drawn to, and gather at, the pixel electrode 21A of the pixel 20A. The migration behavior of the white particles 82 and the black particles 83 explained above is illustrated in FIG. 9B. During the second half of the time period T10 of the second image-erasing sub step throughout which a low electric potential L is applied to the common electrode 22, there occurs no voltage level difference between the electric potential (L) of the pixel electrode 21A of the pixel 20A and the electric potential (L) of the common electrode 22. For this reason, the white particles 82 and the black particles 83 do not migrate in the pixel 20A during the second half of the time period T10 of the second image-erasing sub step. As a result thereof, the operation state of the pixel 20A transitions from a black display state into a white display state. Throughout the time period T10 of the second image-erasing sub step, a high electric potential H is applied to the pixel electrode 21B of the pixel 20B. During the same time period T10 of the second image-erasing sub step, one cycle of a pulse signal is inputted into the common electrode 22. Accordingly, during the first half of the time period T10 of the second image-erasing sub step throughout which a high electric potential H is applied to the common electrode 22, there occurs no voltage level difference between the electric potential (H) of the pixel electrode 21B of the pixel 20B and the electric potential (H) of the common electrode 22. For this reason, the white particles 82 and the black particles 83 do not migrate in the pixel 20B during the first half of the time period T10 of the second image-erasing sub step. On the other hand, during the second half of the time period T10 of the second image-erasing sub step throughout which a low electric potential L is applied to the common electrode 22, there occurs a voltage level difference between the electric potential (H) of the pixel electrode 21B of the pixel 20B and the electric potential (L) of the common electrode 22. Since the electric potential of the pixel electrode 21B of the pixel 20B is higher than the electric potential of the common electrode 22 throughout the second half of the time period T10 of the second image-erasing sub step, the black particles 83 are drawn to, and gather at, the common electrode 22 whereas the white particles 82 are drawn to, and gather at, the pixel electrode 21B of the pixel 20B. The migration behavior of the white particles 82 and the black particles 83 explained above is illustrated in FIG. 9B. As a result thereof, the operation state of the pixel 20B transitions from a white display state into a black display state. Consequently, the display of the display unit 30 transitions from the state (b) of FIG. 7 into the state (c) thereof. During this transition process, the display states of all pixels 200 that make up the display area 30 are reversed. For this reason, the white particles 82 and the black particles 83 are agitated in each pixel 20. During the execution of the second image-erasing sub step of the image-erasing step explained above, very small black areas and very small white areas that are arranged in an alternate array pattern in the display unit 30 are switched over. More specifically, during the execution of the second image-erasing sub step of the image-erasing step explained above, very small black areas and very small white areas that are arrayed in a checkered pattern in the illustrated exemplary configuration of an electrophoresis display device according to the present embodiment of the invention are switched over. Accordingly, they are always perceived by a user as the mixed color of gray when viewed with the naked eye. For this reason, the aforementioned image problem of flashing does not arise at the time when the image displayed on the display unit 30 transitions from the display state (b) of FIG. 7 into the display state (c) thereof; or in other words, during the execution of the second image-erasing sub step of the image-erasing step, which is comfortable to users.

The white particles 82 and the black particles 83 are agitated in the pixels 20A and 20B through the execution of the first and second image-erasing sub steps explained above.

In the driving method of an electrophoresis display device according to the present embodiment of the invention, the first image-erasing sub step is performed again after the second image-erasing sub step explained above. Thereafter, the second image-erasing sub step is performed again after the first image-erasing sub step, followed by the execution of the first image-erasing sub step again. The display state of the display area 30 transitions from FIG. 7(*c*) to FIG. 7(*f*) in a sequential manner as a result of the repetitive execution of the first image-erasing sub step (from the display state (c) of FIG. 7 to the display state (d) thereof), the second image-erasing sub step (from the display state (d) of FIG. 7 to the display state (e) thereof), and the first image-erasing sub step (from the display state (e) of FIG. 7 to the display state (f) thereof). The repetitive execution of the first image-erasing sub steps and the second image-erasing sub steps explained above increases the number of times of agitation of the white particles 82 and the black particles 83. The increased number of times of agitation of the white particles 82 and the black particles 83 makes it possible to erase an old image with enhanced image-erasing performance and reliability, thereby either significantly reducing or completely eliminating the risk of the occurrence of an afterimage.

After the full and sufficient agitation of the white particles 82 and the black particles 83, the process moves onto the third image-erasing sub step of the image-erasing step from the first image-erasing sub step thereof (note that the third image-erasing sub step follows not the second image-erasing sub step but the first image-erasing sub step). The third image-erasing sub step is the last step of the image-erasing step explained herein. The third image-erasing sub step is performed in order to put the operation state of the entire display area 30 into a white display. Unlike the foregoing first and second image-erasing sub steps, the pixels 20A and 20B are driven in the same level pattern that is not opposite to each other in the third image-erasing sub step as explained below. More specifically, throughout the entire time period of the third image-erasing sub step that is performed as the last step of the image erasure step explained herein, a low electric potential L is applied to both of the pixel electrode 21A of the pixel 20A and the pixel electrode 21B of the pixel 20B. This means that a low electric potential L is applied to every pixel electrode in the third image-erasing sub step thereof. On the other hand, during the same time period of the third image-erasing sub step, one cycle of a pulse signal is inputted into the common electrode 22. Accordingly, during the first half of the time period of the third image-erasing sub step throughout which a high electric potential H is applied to the common electrode 22, there occurs a voltage level difference between the electric potential (L) of the pixel electrode 21A of the pixel 20A/the electric potential (L) of the pixel electrode 21B of the pixel 20B and the electric potential (H) of the common electrode 22. That is, each of the electric potential of the pixel electrode 21A of the pixel 20A and the electric potential of the pixel electrode 21B of the pixel 20B is lower than the electric potential of the common electrode 22 throughout the first half of the time period of the third image-erasing sub step. Because of the voltage level difference between the electric potential (L) of the pixel electrode 21A of the pixel 20A and the electric potential (H) of the common electrode 22, the white particles 82 are drawn to, and gather at, the common electrode 22 whereas the black particles 83 are drawn to, and gather at, the pixel electrode 21A of the pixel 20A, which was in a black display state as a result of the completion of the preceding first image-erasing sub step prior to the execution of the third image-erasing sub step described herein. The migration behavior of the white particles 82 and the black particles 83 in the pixel 20A explained above is illustrated in FIG. 9C. On the other hand, despite the fact that there occurs a voltage level difference between the electric potential (L) of the pixel electrode 21B of the pixel 20B and the electric potential (H) of the common electrode 22 during the first half of the time period of the third image-erasing sub step, the white particles 82 and the black particles 83 do not move in the pixel 20B because the pixel 20B was in a white display state as a result of the completion of the preceding first image-erasing sub step prior to the execution of the third image-erasing sub step described herein. The stationary behavior of the white particles 82 and the black particles 83 in the pixel 20B explained above is illustrated in FIG. 9C. During the second half of the time period of the third image-erasing sub step throughout which a low electric potential L is applied to the common electrode 22, there occurs no voltage level difference between the electric potential (L) of the pixel electrode 21A of the pixel 20A/the electric potential (L) of the pixel electrode 21B of the pixel 20B and the electric potential (L) of the common electrode 22. For this reason, the white particles 82 and the black particles 83 do not migrate in each of the pixels 20A and 20B during the second half of the time period of the third image-erasing sub step. As a result thereof, the entire pixel area of the display unit 30, which includes the pixels 20A and 20B, is in a white display state as illustrated in the state diagram FIG. 7(*g*) after the completion of the third image-erasing sub step explained above. The image erasure step is finished after the completion of the third image-erasing sub step described above. Then, the process moves onto the next image-writing step.

In the following description, the image-erasing step is explained. The image-writing step corresponds to a time period during which a new image is written in the display area 30 after the erasure of an old image therefrom through the image-erasing step explained above.

Upon the transition of the first method for driving an electrophoresis display device according to the present embodiment of the invention from the image-erasing step into the image-writing step, a pulse signal having a rectangular waveform is supplied to the common electrode 22. Because of the input of such a rectangular pulse signal, the electric potential of the common electrode 22 switches over between a high electric-potential level H and a low electric-potential level L in an alternate manner. In the timing chart of FIG. 8 as well as in the following description, each of the high-voltage time period during which the electric potential of the common electrode 22 is at a high level H in the image-writing step and the low-voltage time period during which the electric potential of the common electrode 22 is at a low level L in the image-writing step is denoted as T100. A set of one common-electrode high-level time period T100 and one common-electrode low-level time period T100 in the image-writing step is equal to one cycle of the rectangular pulse signal applied to the common electrode 22 therein. A low electric potential L is inputted into the pixel electrode 21 of each of the pixels 20 whose operation state are to be transitioned into a white display state, whereas a high electric potential H is inputted into the pixel electrode 21 of each of the pixels 20 whose operation state are to be transitioned into a black display state. As a result of the supplying of a low electric potential L to the pixel electrode 21 of each of the pixels 20 whose operation state are to be transitioned into a white display state and the supplying of a high electric potential H to the pixel electrode 21 of each of the pixels 20 whose operation state are to be transitioned into a black display state, a potential electric difference is generated between the pixel electrode 21 of each of the pixels 20 whose operation state are to be transitioned into a white display state and the common electrode 22 during a time period in which a high electric potential H is supplied to the common electrode 22. Despite the fact that such a voltage level difference occurs, the white particles 82 and the black particles 83 do not move in the above-mentioned to-be-white-displayed pixels 20 because all of the pixels 20 were in a white display state as a result of the completion of the preceding image-erasing sub step prior to the execution of the image-writing sub step described herein. On the other hand, as a result of the supplying of a low electric potential L to the pixel electrode 21 of each of the pixels 20 whose operation state are to be transitioned into a white display state and the supplying of a high electric potential H to the pixel electrode 21 of each of the pixels 20 whose operation state are to be transitioned into a black display state, a potential electric difference is generated between the pixel electrode 21 of each of the pixels 20 whose operation state are to be transitioned into a black display state and the common electrode 22 during a time period in which a low electric potential H is supplied to the common electrode 22. Because of the electric potential difference generated therebetween and the resultant migration of electrophoresis elements, the operation state of each of the above-mentioned to-be-black-displayed pixels 20 transitions into a black display state. In the driving method of an electrophoresis display device according to the present embodiment of the invention, the length of each of the aforementioned common-electrode high-level time period T100 during which the electric potential of the common electrode 22 is held at a high level H in the image-writing step and the aforementioned common-electrode low-level time period T100 during which the electric potential of the common electrode 22 is held at a low level L in the image-writing step is set as approximately 0.3 s. In addition, in the driving method of an electrophoresis display device according to the present embodiment of the invention, the entire length of the image-writing step is set as approximately 2 s.

As explained above, in the driving method of an electrophoresis display device according to the present embodiment of the invention, the length of each of the aforementioned common-electrode high-level time period T100 during which the electric potential of the common electrode 22 is held at a high level H in the image-writing step and the aforementioned common-electrode low-level time period T100 during which the electric potential of the common electrode 22 is held at a low level L in the image-writing step is set as approximately 0.3 s, whereas the length of each of the aforementioned common-electrode high-level time period T1 during which the electric potential of the common electrode 22 is held at a high level H in the image-erasing step and the aforementioned common-electrode low-level time period T1 during which the electric potential of the common electrode 22 is held at a low level L in the image-erasing step is set as approximately 0.1 s. That is, in the driving method of an electrophoresis display device according to the present embodiment of the invention, the writing level of the image-erasing step is relatively low (i.e., "weaker writing") in comparison with that of the image-writing step. Because of the lesser writing intensity in the pixel-writing operation of the image erasure step, to be exact, the white particles 82/black particles 83 do not move completely to the pixel electrode 21/common electrode 22 when they migrate toward the pixel electrode 21/common electrode 22 during the execution of the image erasure step. For this reason, it is possible to significantly reduce or completely eliminate the risk of a residual image. The reason why the writing level of the image-erasing step is relatively low in comparison with that of the image-writing step is that the purpose of writing (i.e., image display) performed in the image-erasing step is to merely erase an old image. That is, it simply aims to fully agitate the white particles 82 and the black particles 83. The agitation of the white particles 82 and the black particles 83 to a sufficient level makes the migration behavior (i.e., movement) thereof smoother. By this means, it is possible to display an image that is written in the image-writing step more clearly. In addition, because of the lesser writing intensity in the pixel-writing operation of the image erasure step, a gray-scale color that is displayed in each pixel is, in an exact sense, not pure black/white (i.e., perfect black/white). For this reason, it is substantially more likely for a user to perceive the mixed color of gray during the execution of the image-erasing step, making it possible to effectively prevent or suppress the aforementioned flashing phenomenon. In the foregoing description of the first driving method of an electrophoresis display device according to the present embodiment of the invention, it is explained that the length of each of the aforementioned common-electrode high-level time period T1 during which the electric potential of the common electrode 22 is held at a high level H in the image-erasing step and the aforementioned common-electrode low-level time period T1 during which the electric potential of the common electrode 22 is held at a low level L in the image-erasing step is approximately one third of the length of each of the aforementioned common-electrode high-level time period T100 during which the electric potential of the common electrode 22 is held at a high level H in the image-writing step and the aforementioned common-electrode low-level time period T100 during which the electric potential of the common electrode 22 is held at a low level L in the image-writing step. However, the scope of the invention is not limited to such a specific example. As a non-limiting modification example thereof, the length of the time period T1 may be any other value as long as it is less than a half of the time period T100. Even with such a modified configuration, it is possible to erase an old image with enhanced image-erasing performance and reliability while effectively suppressing the occurrence of an afterimage.

In the foregoing description of the first driving method of an electrophoresis display device according to the present embodiment of the invention, it is explained that each one of a plurality of pixels that are arrayed in a grid matrix pattern, a non-limiting example of which is the pixel 20A/20B, is taken as the minimum unit of very small areas, which correspond to the first areas/second areas according to an aspect of the invention. However, the scope of the invention is not limited to such a specific example. For example, not a single pixel 20 but a block of pixels 20 may be set as the minimum unit of very small areas (the first areas/second areas). In such a modified configuration, each block is made up of two to nine pixels 20, without any limitation thereto. In the foregoing description of the first driving method of an electrophoresis display device according to the present embodiment of the invention, it is explained that the time period of each of the first image-erasing sub step, the second image-erasing sub step, and the third image-erasing sub step corresponds to one cycle of a pulse signal that is supplied to the common electrode 22. However, the scope of the invention is not limited to such a specific example. As a non-limiting modification example thereof, the time period of the first image-erasing sub step, the second image-erasing sub step, and/or the third image-erasing sub step may correspond to not one but more than one cycle of a pulse signal that is supplied to the common electrode 22. The number of times of repetition of the first image erasing sub steps and the second image-erasing sub steps is not limited to the foregoing specific example. For example, the number of times of repetition of the first image erasing sub steps and the second image-erasing sub steps may be larger than that of the foregoing specific example. With the increased number of times of repetition of the first image-erasing sub steps and the second image-erasing sub steps, it is possible to ensure better agitation of the white particles 82 and the black particles 83, which results in further improved reduction/prevention of a residual image.

The electrophoresis display device 1 according to the present embodiment of the invention, which is operated by means of the first driving method explained above, offers the following advantageous effects of the invention. In the image-erasing step, each one of a plurality of pixels that are arrayed in a grid matrix pattern is taken as the minimum unit of minute areas that perform black/white alternate display. In the preceding sentence, the (minimum unit of) minute areas correspond(s) to the first areas/second areas according to an aspect of the invention. In addition, in the image-erasing step, white display and black display are provided in a checkered array pattern in the display area of the display unit 30. Therefore, at the time when the very small black area and the very small white area (each of which is the single pixel 20 in the illustrated exemplary configuration of the electrophoresis display device 1 according to the present embodiment of the invention) that are arrayed adjacent to each other are switched over in an alternate manner, they are always perceived by a user as the mixed color of gray when viewed with the naked eye. For this reason, during the execution of image-erasing operation, a user does not observe any change in mixed gray display as viewed with the naked eye. Thus, the electrophoresis display device 1 according to the present embodiment of the invention and the first method for driving the electrophoresis display device 1 according to the present embodiment of the invention make it possible to achieve image-erasing operation free from the flashing problem. Through the repetition of the first image-erasing sub steps and the second image-erasing sub steps, display is reversed in an alternate manner so as to agitate the white particles 82 and the black particles 83. By this means, it is possible to improve image display quality while effectively preventing or suppressing a residual image.

The unit area size of the checkered array pattern may be made larger than that of the foregoing specific example. As long as the modified area size thereof is not too large, a user perceives the mixed color of gray, making it possible to effectively prevent or suppress the aforementioned flashing phenomenon. A rectangular area that has a width corresponding to the aggregate width of a certain number of pixels arrayed along the scanning line 40 may be set as the minimum unit of very small areas with white display and black display being provided in a "rectangular-checkered" array pattern. Or, as another non-limiting modification example thereof, a rectangular area that has a width corresponding to the aggregate width of a certain number of pixels arrayed along the data line 50 may be set as the minimum unit of very small areas with white display and black display being provided in a rectangular-checkered array pattern. At the time when the very small black area and the very small white area (each of which is the rectangular area in the modification example described herein) that are arrayed adjacent to each other are switched over in an alternate manner, they are perceived by a user as the mixed color of gray when viewed with the naked eye. Therefore, it is possible to achieve significant reduction in flashing at the time of display-updating operation.

The repetitive execution of the first image-erasing sub steps and the second image-erasing sub steps explained above ensures the increased number of times of agitation of the white particles 82 and the black particles 83. The increased number of times of agitation of the white particles 82 and the black particles 83 makes it possible to erase an old image with enhanced image-erasing performance and reliability, thereby either significantly reducing or completely eliminating the risk of the occurrence of an afterimage. Thus, the electrophoresis display device 1 according to the present embodiment of the invention and the first method for driving the electrophoresis display device 1 according to the present embodiment of the invention make it possible to enhance image display quality.

Since the pulsed common switchover scheme mentioned above is employed in the electrophoresis display device 1 according to the present embodiment of the invention and the first method for driving the electrophoresis display device 1 according to the present embodiment of the invention, it is possible to perform the image-erasing step by means of two electric-potential levels only, that is, a low electric potential level L and a high electric potential level H. The use of only two voltage levels for the execution of the image-erasing step makes it possible to reduce the burden of the control of the electric potential levels that are applied to the pixel electrode 21 and the common electrode 22. In addition, through the inputting of a rectangular pulse signal into the common electrode 22, which causes the electric potential of the common electrode 22 to switch over between a high electric-potential level H and a low electric-potential level L in an alternate manner, it is possible to achieve black-and-white display on the plurality of pixels 20 in a concurrent manner where some pixels 20 are in a white display state whereas other pixels 20 are in a black display state, which alternate with each other. For this reason, the electrophoresis display device 1 according to the present embodiment of the invention and the first method for driving the electrophoresis display device 1 according to the present embodiment of the invention make it possible to achieve fast black/white display reversal/turnover/switchover and thus fast image erasure.

Variation Example

Figure 10:
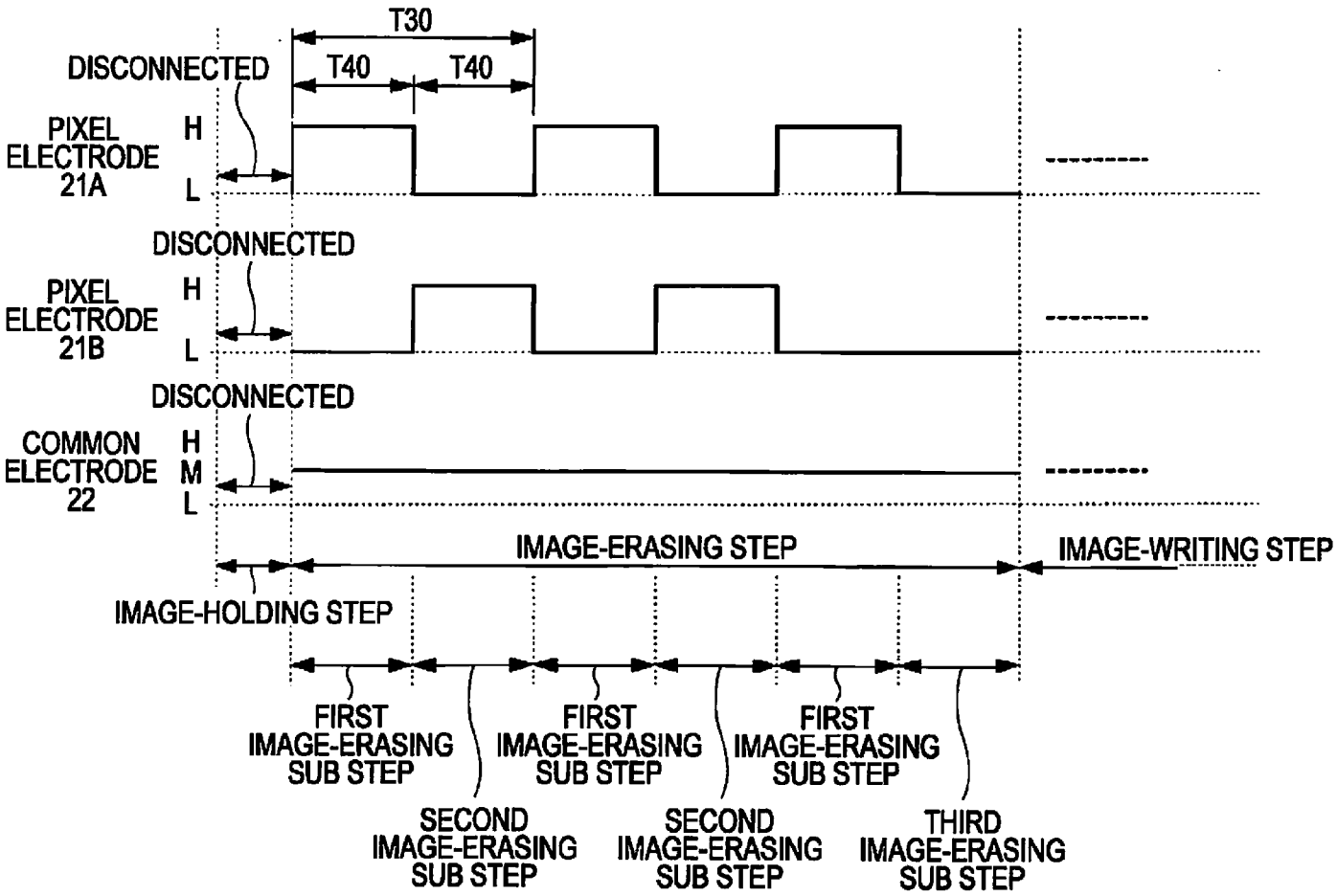
FIG. 10 is a timing chart that schematically illustrates an example of the timing operation of a modified method for driving the electrophoresis display device 1 according to an exemplary embodiment of the invention.

Next, one variation example of the first method for driving an electrophoresis display device according to the present embodiment of the invention is explained below. In a non-limiting modified method for driving an electrophoresis display device according to the present embodiment of the invention, the pulsed common switchover scheme explained above is not used. Instead of inputting a rectangular pulse signal into the common electrode 22 so as to cause the electric potential of the common electrode 22 to switch over between a high electric-potential level H and a low electric-potential level L in an alternate manner, in the modified method for driving an electrophoresis display device according to the present embodiment of the invention described below, a medium electric potential M that is an intermediate voltage level between a high electric potential H and a low electric potential is applied to the common electrode 22. FIG. 10 is a timing chart that schematically illustrates an example of the timing operation of a modified method for driving an electrophoresis display device according to the present embodiment of the invention. An image-holding step, an image-erasing step, and an image-writing step are executed in the modified method for driving an electrophoresis display device according to the present embodiment of the invention. In this point, the modified driving method of an electrophoresis display device described herein is the same as the first driving method of an electrophoresis display device explained above. In addition, the image-erasing step of the modified electrophoresis-display-device driving method described herein consists of the first image-erasing sub step(s), the second image-erasing sub step(s), and the third image-erasing sub step, which is also the same as the image-erasing step of the first electrophoresis-display-device driving method explained above. As a point of difference between the first electrophoresis-display-device driving method explained above and the modified electrophoresis-display-device driving method described below, a medium electric potential M is inputted in the common electrode 22 throughout the entire time period of the image-erasing step in the latter method. In the following description, the specific operation of the modified method for driving an electrophoresis display device according to the present embodiment of the invention is explained in detail. Throughout the entire time period (T40) of the first image-erasing sub step, a high electric potential H is applied to the pixel electrode 21A of the pixel 20A whereas a low electric potential L is applied to the pixel electrode 21B of the pixel 20B. Throughout the entire time period (T40) of the second image-erasing sub step, a low electric potential L is applied to the pixel electrode 21A of the pixel 20A whereas a high electric potential H is applied to the pixel electrode 21B of the pixel 20B. Throughout the entire time period of the third image-erasing sub step that is performed as the last step of the image erasure step, a low electric potential L is applied to both of the pixel electrode 21A of the pixel 20A and the pixel electrode 21B of the pixel 20B.

Unlike the driving operation of the pulsed common switchover scheme explained above, there is always an electric potential difference between the pixel electrode 21A of the pixel 20A and the common electrode 22 as well as between the pixel electrode 21B of the pixel 20B and the common electrode 22 because a non-pulsed medium electric potential M is applied to the common electrode 22 throughout the entire time period of the image-erasing step if the modified method for driving an electrophoresis display device according to the present embodiment of the invention is adopted. For this reason, an image change occurs in the pixels 20A and 20B in a concurrent manner. For example, the electric potential of the pixel electrode 21A of the pixel 20A is higher than the electric potential of the common electrode 22 throughout the entire time period T40 of the first image-erasing sub step. Therefore, during the execution of the first image-erasing sub step, the black particles 83 are drawn to, and gather at, the common electrode 22 whereas the white particles 82 are drawn to, and gather at, the pixel electrode 21A of the pixel 20A. As a result thereof, the operation state of the pixel 20A switches over from a white display state into a black display state; or, the operation state of the pixel 20A switches over from a white display state into a gray display state as a result of the migration behavior of electrophoresis particles explained above. On the other hand, the electric potential of the pixel electrode 21B of the pixel 20B is lower than the electric potential of the common electrode 22 throughout the entire time period T40 of the first image-erasing sub step. Therefore, during the execution of the first image-erasing sub step, the white particles 82 are drawn to, and gather at, the common electrode 22 whereas the black particles 83 are drawn to, and gather at, the pixel electrode 21B of the pixel 20B. As a result thereof, the operation state of the pixel 20B switches over from a black display state into a white display state; or, the operation state of the pixel 20B switches over from a black display state into a gray display state as a result of the migration behavior of electrophoresis particles explained above. It should be noted that the migration of electrophoresis particles and the resultant switchover of display states occur in the pixels 20A and 20B concurrently. In the modified method for driving an electrophoresis display device according to the present embodiment of the invention described herein, there is a possibility that the display-state transition of each pixel 20 does not occur completely and/or perfectly prior to the writing of a new image because the value of an electric potential difference between the pixel electrode 21A of the pixel 20A and the common electrode 22 as well as between the pixel electrode 21B of the pixel 20B and the common electrode 22 during the execution of image-erasing operation is a half of the value of an electric potential difference between the pixel electrode 21A of the pixel 20A and the common electrode 22 as well as between the pixel electrode 21B of the pixel 20B and the common electrode 22 during the execution of image-writing operation. Despite the fact that there is such a possibility, it does not negatively affect image display because such incomplete and/or imperfect display-state transition, if any, occurs during the image-erasing operation only, which is performed for the purpose of erasing an old image. Such incomplete and/or imperfect display-state transition during the execution of the image-erasing operation rather becomes an advantage in that it helps to prevent the occurrence of the aforementioned flashing in the course thereof.

As explained above, as a point of difference between the first electrophoresis-display-device driving method and the modified electrophoresis-display-device driving method, a medium electric potential M is inputted in the common electrode 22 throughout the entire time period of the image-erasing step in the latter method whereas the pulsed common switchover scheme is used therein in the former method. Unlike the driving operation of the pulsed common switchover scheme explained earlier, there is always an electric potential difference between the pixel electrode 21A of the pixel 20A and the common electrode 22 as well as between the pixel electrode 21B of the pixel 20B and the common electrode 22 because a non-pulsed medium electric potential M is applied to the common electrode 22 throughout the entire time period of the image-erasing step in the modified method for driving an electrophoresis display device according to the present embodiment of the invention. For this reason, an image change occurs in the pixels 20A and 20B in a concurrent manner if the modified driving method described herein is adopted, which makes it possible to complete the image-erasing operation in a shorter time period. When the display states of the pixels 20 switch over through the repetition of the first image-erasing sub steps and the second image-erasing sub steps, a user does not perceive any change in the mixed color of gray when viewed with the naked eye. Therefore, it is possible to achieve significant reduction in flashing at the time of display-updating operation. Through the repetition of the first image-erasing sub steps and the second image-erasing sub steps, display is reversed in an alternate manner so as to agitate the white particles 82 and the black particles 83. By this means, it is possible to improve image display quality while effectively preventing or suppressing a residual image.

Second Method for Driving Electrophoresis Display Device

Next, an explanation is given below of a second method for driving an electrophoresis display device according to an exemplary embodiment of the invention. In a brief non-limiting summary, the second method for driving an electrophoresis display device according to the present embodiment of the invention has the following features. Each column group of pixels 20 that are connected to the same single data line 50 is taken as the minimum unit of minute areas, which correspond to the first areas/second areas according to an aspect of the invention. White display and black display are provided in a vertical stripe array pattern. The vertical-stripe-arrayed white display and the vertical-stripe-arrayed black display are switched over in an alternate manner for image erasure. A more detailed explanation of the features of the second method for driving an electrophoresis display device according to the present embodiment of the invention is given below. Taking an example of an arbitrary 5×5 matrix portion of the entire display area 30, the second method for driving an electrophoresis display device according to the present embodiment of the invention is explained below. The arbitrary 5×5 matrix area has the total twenty-five (25) pixels 20 that are arrayed in a matrix pattern made up of five rows and five columns. Each of five rows extends along the scanning line 40, that is, in the X direction. Each of five columns extends along the data line 50, that is, in the Y direction.

Figure 11:
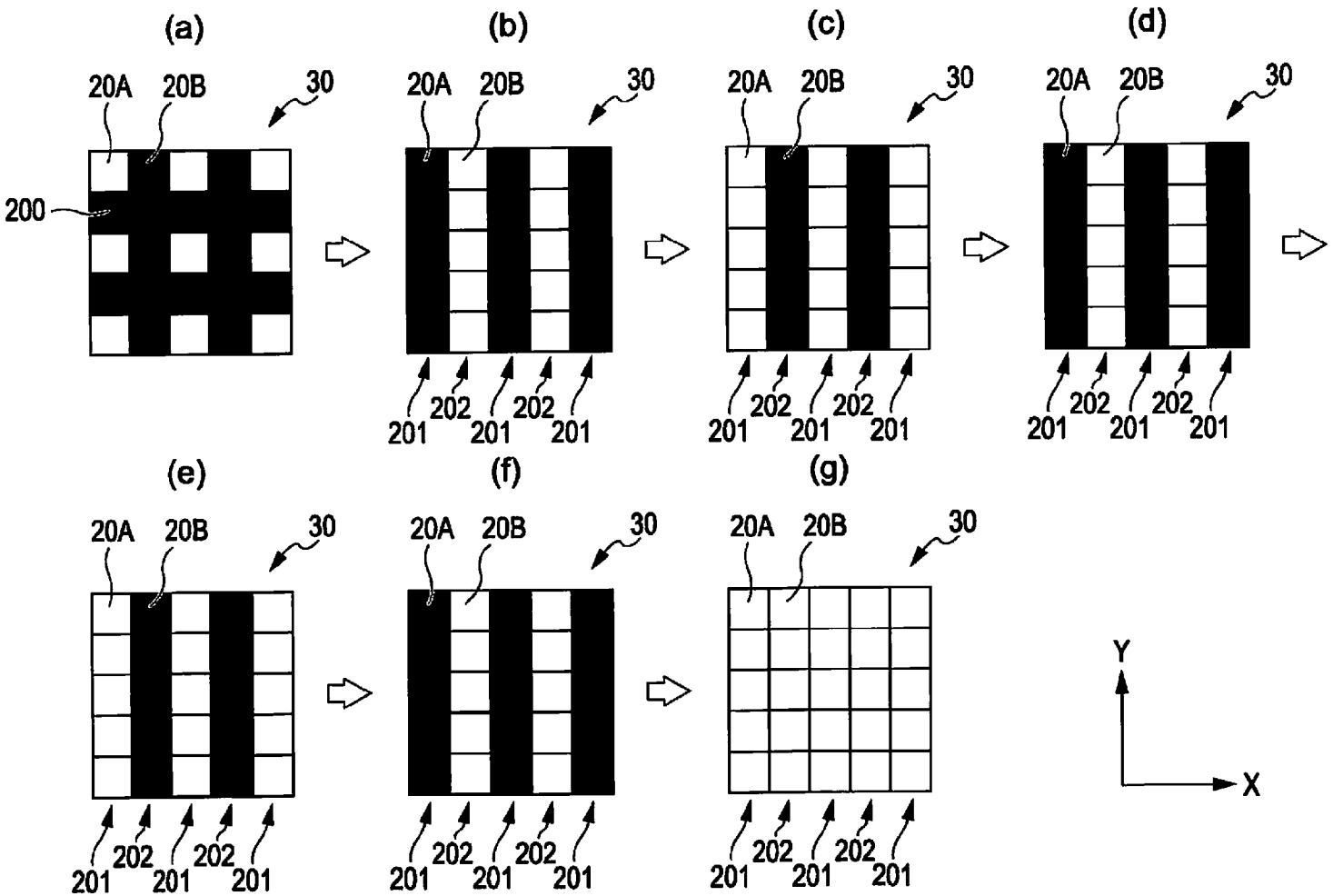
FIG. 11 is a display-state transition diagram that schematically illustrates an example of the image pattern of the display unit/area 30 of the electrophoresis display device 1 where such a display-state transition occurs in an image-erasing step of a second method for driving the electrophoresis display device 1 according to an exemplary embodiment of the invention.

FIG. 11 is a display-state transition diagram that schematically illustrates an example of the image pattern of the display unit 30 of an electrophoresis display device according to the second exemplary embodiment of the invention where such a display-state transition occurs at the time of image-erasing operation thereof. In the second method for driving an electrophoresis display device according to the present embodiment of the invention, each column group of pixels 20 that are connected to the same single data line 50 extending in the vertical direction (i.e., Y direction) is taken as the minimum unit of minute areas. A plurality of such very small areas is arrayed in a vertical stripe pattern in the display area 30. As illustrated in FIG. 11, in the second method for driving an electrophoresis display device according to the present embodiment of the invention, first areas 201 and second areas 202 each of which is elongated along the extending direction of the corresponding data line 50 are arrayed adjacent to each other and in an alternate order as viewed in the extending direction of the scanning lines 40. Therefore, the first areas 201 and the second areas 202 are arrayed as vertical stripes. In the process of image-erasing operation of the second method for driving an electrophoresis display device according to the present embodiment of the invention, an image 200, which has the shape of a lattice (a right-angled sharp sign #) as shown in the initial display state (a) of FIG. 11, is erased through a series of alternate switchovers of vertical-stripe-arrayed black-and-white display between the first areas 201 and the second areas 202. In the following description of the second method for driving an electrophoresis display device according to the present embodiment of the invention, the uppermost and leftmost pixel is chosen as a non-limiting example of a plurality of pixels 20 that make up the first areas 201. The uppermost pixel in the second column from the left, which is adjacent to the uppermost and leftmost pixel, is chosen as a non-limiting example of a plurality of pixels 20 that make up the second areas 202. In the 5×5 matrix diagram of FIG. 11, the uppermost and leftmost pixel is denoted as 20A. The uppermost pixel in the second column from the left, which is adjacent to the uppermost and leftmost pixel 20A, is denoted as 20B. In the following description of the second method for driving an electrophoresis display device according to the present embodiment of the invention, our attention is directed to the display-state transition of these pixels 20A and 20B during the execution of image-erasing step thereof. It is assumed that the pulsed common switchover scheme is adopted in the following description of the second method for driving an electrophoresis display device according to the present embodiment of the invention without any intention to limit the technical scope thereof. The timing pattern/behavior of pulse signals that are applied to the pixel electrode 21A of the pixel 20A, the pixel electrode 21B of the pixel 20B, and the common electrode 22 in the second electrophoresis-display-device driving method described below is the same as that of the timing chart of FIG. 8, which schematically illustrates an example of the timing operation of the first electrophoresis-display-device driving method explained above. In addition, the migrating pattern/behavior of the white particles 82 and the black particles 83 in the second electrophoresis-display-device driving method described below is the same as that of FIGS. 9A, 9B, and 9C, which is a set of diagrams that schematically illustrates an example of the migration/movement of electrophoresis particles in the image-erasing step of the first electrophoresis-display-device driving method explained above. Therefore, the second method for driving an electrophoresis display device according to the present embodiment of the invention is explained while making reference to FIGS. 8 and 9 as well as FIG. 11.

The state diagram (a) of FIG. 11 corresponds to the image-holding step of FIG. 8. As a result of the execution of the first image-erasing sub step, the display state of the display area 30 transitions from the initial state (a) of FIG. 11 to the next state (b) thereof. As illustrated in FIG. 8, a high electric potential H is supplied to the pixel electrode 21A of the pixel 20A in (i.e., throughout the entire time period T10 of) the first image-erasing sub step. During the same time period T10 of the first image-erasing sub step, one cycle of a pulse signal is inputted into the common electrode 22 so as to cause the electric potential of the common electrode 22 to switch over between a high electric-potential level H and a low electric-potential level L. As a result of the supplying of a high electric potential H to the pixel electrode 21A of the pixel 20A throughout the entire time period T10 of the first image-erasing sub step and the supplying of a "pulsed common switchover signal" to the common electrode 22 therein, during the second half of the time period T10 of the first image-erasing sub step throughout which a low electric potential L is applied to the common electrode 22, there occurs a voltage level difference between the electric potential (H) of the pixel electrode 21A of the pixel 20A and the electric potential (L) of the common electrode 22. Since the electric potential of the pixel electrode 21A of the pixel 20A is higher than the electric potential of the common electrode 22 throughout the second half of the time period T10 of the first image-erasing sub step, the black particles 83 are drawn to, and gather at, the common electrode 22 whereas the white particles 82 are drawn to, and gather at, the pixel electrode 21A of the pixel 20A. The migration behavior of the white particles 82 and the black particles 83 explained above is illustrated in FIG. 9A. As a result thereof, the operation state of the pixel 20A, which was in a white display state at its initial status, transitions into a black display state. That is, the display color of the first areas 201 is black after the completion of the first image-erasing sub step explained above. It should be remembered that the pixel 20A is taken as a non-limiting example out of the plurality of pixels 20 that make up the first areas 201. Any other pixel that is not in a white display state but in a black display state at its initial status may be taken as an alternative example of the plurality of pixels 20 that make up the first areas 201. If the pixel 20A is not in a white display state but in a black display state at its initial status, the white particles 82 and the black particles 83 do not migrate in the pixel 20A during the second half of the time period T10 of the first image-erasing sub step. Throughout the time period T10 of the first image-erasing sub step, a low electric potential L is applied to the pixel electrode 21B of the pixel 20B. As a result of the supplying of a low electric potential L to the pixel electrode 21B of the pixel 20B throughout the entire time period T10 of the first image-erasing sub step and the supplying of the pulsed common switchover signal to the common electrode 22 therein, during the first half of the time period T10 of the first image-erasing sub step throughout which a high electric potential H is applied to the common electrode 22, there occurs a voltage level difference between the electric potential (L) of the pixel electrode 21B of the pixel 20B and the electric potential (H) of the common electrode 22. Since the electric potential of the pixel electrode 21B of the pixel 20B is lower than the electric potential of the common electrode 22 throughout the first half of the time period T10 of the first image-erasing sub step, the white particles 82 are drawn to, and gather at, the common electrode 22 whereas the black particles 83 are drawn to, and gather at, the pixel electrode 21B of the pixel 203. The migration behavior of the white particles 82 and the black particles 83 explained above is illustrated in FIG. 9A. As a result thereof, the operation state of the pixel 20B, which was in a black display state at its initial status, transitions into a white display state. That is, the display color of the second areas 202 is white after the completion of the first image-erasing sub step explained above. If the pixel 20B is not in a black display state but in a white display state at its initial status, the white particles 82 and the black particles 83 do not migrate in the pixel 20B during the first half of the time period T10 of the first image-erasing sub step. The image (200) displayed on the display area 30 transitions from the display state (a) of FIG. 11 into the display state (b) thereof as a result of the execution of the first image-erasing sub step explained above. Vertical stripes are displayed after the execution of the first image-erasing sub step as shown in FIG. 11(*b*). The white particles 82 and the black particles 83 are agitated in the course of the execution of the first image-erasing sub step. Since very small black areas and very small white areas are arranged in an alternate array pattern in the display unit 30, or more specifically, in a vertical stripe array pattern in the illustrated exemplary configuration of an electrophoresis display device according to the present embodiment of the invention, they are always perceived by a user as the mixed color of gray when viewed with the naked eye. For this reason, the aforementioned image problem of flashing does not arise, which is comfortable to users.

Subsequently, the image displayed on the display area 30 transitions from the display state (b) of FIG. 11 into the display state (c) thereof as a result of the execution of the second image-erasing sub step. Throughout the entire time period T10 of the second image-erasing sub step, a low electric potential L is applied to the pixel electrode 21A of the pixel 20A. During the same time period T10 of the second image-erasing sub step, (one cycle of) the pulsed common switchover signal is inputted into the common electrode 22 so as to cause the electric potential of the common electrode 22 to switch over between a high electric-potential level H and a low electric-potential level L. As a result of the supplying of a low electric potential L to the pixel electrode 21A of the pixel 20A throughout the entire time period T10 of the second image-erasing sub step and the supplying of the pulsed common switchover signal to the common electrode 22 therein, during the first half of the time period T10 of the second image-erasing sub step throughout which a high electric potential H is applied to the common electrode 22, there occurs a voltage level difference between the electric potential (L) of the pixel electrode 21A of the pixel 20A and the electric potential (H) of the common electrode 22. Since the electric potential of the pixel electrode 21A of the pixel 20A is lower than the electric potential of the common electrode 22 throughout the first half of the time period T10 of the second image-erasing sub step, the white particles 82 are drawn to, and gather at, the common electrode 22 whereas the black particles 83 are drawn to, and gather at, the pixel electrode 21A of the pixel 20A. The migration behavior of the white particles 82 and the black particles 83 explained above is illustrated in FIG. 9B. As a result thereof, the operation state of the pixel 20A that was in a black display state transitions into a white display state. That is, the display color of the first areas 201 is white after the completion of the second image-erasing sub step explained above. Throughout the time period T10 of the second image-erasing sub step, a high electric potential H is applied to the pixel electrode 21B of the pixel 20B. As a result of the supplying of a high electric potential H to the pixel electrode 21B of the pixel 20B throughout the entire time period T10 of the second image-erasing sub step and the supplying of the pulsed common switchover signal to the common electrode 22 therein, during the second half of the time period T10 of the second image-erasing sub step throughout which a low electric potential L is applied to the common electrode 22, there occurs a voltage level difference between the electric potential (H) of the pixel electrode 21B of the pixel 20B and the electric potential (L) of the common electrode 22. Since the electric potential of the pixel electrode 21B of the pixel 20B is higher than the electric potential of the common electrode 22 throughout the second half of the time period T10 of the second image-erasing sub step, the black particles 83 are drawn to, and gather at, the common electrode 22 whereas the white particles 82 are drawn to, and gather at, the pixel electrode 21B of the pixel 20B. The migration behavior of the white particles 82 and the black particles 83 explained above is illustrated in FIG. 9B. As a result thereof, the operation state of the pixel 20B that was in a white display state transitions into a black display state. That is, the display color of the second areas 202 is black after the completion of the second image-erasing sub step explained above. The image displayed on the display area 30 transitions from the display state (b) of FIG. 11 into the display state (c) thereof as a result of the execution of the second image-erasing sub step explained above. Vertical stripes of reversed display color are displayed after the execution of the second image-erasing sub step as shown in FIG. 11(*c*). The white particles 82 and the black particles 83 are agitated in the course of the execution of the second image-erasing sub step. Very small black areas and very small white areas whose display colors are reversed in the course of or as a result of the execution of the second image-erasing sub step explained above are arranged in an alternate array pattern in the display unit 30, or more specifically, in a vertical stripe array pattern in the illustrated exemplary configuration of an electrophoresis display device according to the present embodiment of the invention. Therefore, they are always perceived by a user as the mixed color of gray when viewed with the naked eye. That is, the reversal/turnover/switchover of display colors thereof is not observed. For this reason, the aforementioned image problem of flashing does not arise, which is comfortable to users.

In the driving method of an electrophoresis display device according to the present embodiment of the invention, the first image-erasing sub step is performed again after the second image-erasing sub step explained above. Thereafter, the second image-erasing sub step is performed again after the first image-erasing sub step, followed by the execution of the first image-erasing sub step again. That is, the display state of the display area 30 transitions from FIG. 11(*c*) to FIG. 11(*f*) in a sequential manner as a result of the repetitive execution of the first image-erasing sub step (from the display state (c) of FIG. 11 to the display state (d) thereof), the second image-erasing sub step (from the display state (d) of FIG. 11 to the display state (e) thereof), and the first image-erasing sub step (from the display state (e) of FIG. 11 to the display state (f) thereof). The white particles 82 and the black particles 83 are further agitated through the consecutive reversal (e.g., turnover, or switchover, though not limited thereto) of display colors (e.g., display states, or display image, though not limited thereto) from FIG. 11(*c*) to FIG. 11(*f*). Very small black areas and very small white areas whose display colors are reversed in the course of or as a result of the execution of the second (from (b) to (c)) and subsequent (from (c) to (f)) image-erasing sub steps explained above are arranged in an alternate array pattern in the display unit 30, or more specifically, in a vertical stripe array pattern in the illustrated exemplary configuration of an electrophoresis display device according to the present embodiment of the invention. Therefore, they are always perceived by a user as the mixed color of gray when viewed with the naked eye. For this reason, the aforementioned image problem of flashing does not arise, which is comfortable to users.

After the full and sufficient agitation of the white particles 82 and the black particles 83, the process moves onto the third image-erasing sub step of the image-erasing step from the first image-erasing sub step thereof (note that the third image-erasing sub step follows not the second image-erasing sub step but the first image-erasing sub step). More specifically, throughout the entire time period of the third image-erasing sub step that is performed as the last step of the image erasure step explained herein, a low electric potential L is applied to both of the pixel electrode 21A of the pixel 20A and the pixel electrode 21B of the pixel 20B. This means that a low electric potential L is applied to every pixel electrode in the third image-erasing sub step thereof. On the other hand, during the same time period of the third image-erasing sub step, one cycle of a pulse signal (i.e., pulsed common switchover signal) is inputted into the common electrode 22. Accordingly, during the first half of the time period of the third image-erasing sub step throughout which a high electric potential H is applied to the common electrode 22, there occurs a voltage level difference between the electric potential (L) of the pixel electrode 21A of the pixel 20A/the electric potential (L) of the pixel electrode 21B of the pixel 20B and the electric potential (H) of the common electrode 22. That is, each of the electric potential of the pixel electrode 21A of the pixel 20A and the electric potential of the pixel electrode 21B of the pixel 20B is lower than the electric potential of the common electrode 22 throughout the first half of the time period of the third image-erasing sub step. Because of the voltage level difference between the electric potential (L) of the pixel electrode 21A of the pixel 20A and the electric potential (H) of the common electrode 22, the white particles 82 are drawn to, and gather at, the common electrode 22 whereas the black particles 83 are drawn to, and gather at, the pixel electrode 21A of the pixel 20A, which was in a black display state as a result of the completion of the preceding first image-erasing sub step prior to the execution of the third image-erasing sub step described herein. The migration behavior of the white particles 82 and the black particles 83 in the pixel 20A explained above is illustrated in FIG. 9C. On the other hand, despite the fact that there occurs a voltage level difference between the electric potential (L) of the pixel electrode 21B of the pixel 20B and the electric potential (H) of the common electrode 22 during the first half of the time period of the third image-erasing sub step, the white particles 82 and the black particles 83 do not move in the pixel 20B because the pixel 20B was in a white display state as a result of the completion of the preceding first image-erasing sub step prior to the execution of the third image-erasing sub step described herein. The stationary behavior of the white particles 82 and the black particles 83 in the pixel 20B explained above is illustrated in FIG. 9C. As a result thereof, the entire pixel area of the display unit 30, which includes the pixels 20A and 20B, is in a white display state as illustrated in the state diagram FIG. 11(*g*) after the completion of the third image-erasing sub step explained above. The image erasure step is finished after the completion of the third image-erasing sub step described above. Then, the process moves onto the next image-writing step.

As in the first driving method of an electrophoresis display device explained earlier, in the second driving method of an electrophoresis display device according to the present embodiment of the invention, the length of each of the aforementioned common-electrode high-level time period T100 during which the electric potential of the common electrode 22 is held at a high level H in the image-writing step and the aforementioned common-electrode low-level time period T100 during which the electric potential of the common electrode 22 is held at a low level L in the image-writing step is set as approximately 0.3 s, whereas the length of each of the aforementioned common-electrode high-level time period T1 during which the electric potential of the common electrode 22 is held at a high level H in the image-erasing step and the aforementioned common-electrode low-level time period T1 during which the electric potential of the common electrode 22 is held at a low level L in the image-erasing step is set as approximately 0.1 s. That is, as in the first driving method of an electrophoresis display device explained earlier, in the second driving method of an electrophoresis display device according to the present embodiment of the invention, the writing level of the image-erasing step is relatively low (i.e., "weaker writing") in comparison with that of the image-writing step. Because of the lesser writing intensity in the pixel-writing operation of the image erasure step, to be exact, the white particles 82/black particles 83 do not move completely to the pixel electrode 21/common electrode 22 when they migrate toward the pixel electrode 21/common electrode 22 during the execution of the image erasure step. For this reason, it is possible to significantly reduce or completely eliminate the risk of a residual image. The reason why the writing level of the image-erasing step is relatively low in comparison with that of the image-writing step is that the purpose of writing (i.e., image display) performed in the image-erasing step is to merely erase an old image. That is, it simply aims to fully agitate the white particles 82 and the black particles 83. The agitation of the white particles 82 and the black particles 83 to a sufficient level makes the migration behavior (i.e., movement) thereof smoother. By this means, it is possible to display an image that is written in the image-writing step more clearly. In addition, because of the lesser writing intensity in the pixel-writing operation of the image erasure step, a gray-scale color that is displayed in each pixel is, in an exact sense, not pure black/white (i.e., perfect black/white). For this reason, it is substantially more likely for a user to perceive the mixed color of gray during the execution of the image-erasing step, making it possible to effectively prevent or suppress the aforementioned flashing phenomenon. In the foregoing description of the second driving method of an electrophoresis display device according to the present embodiment of the invention, it is explained that the length of each of the aforementioned common-electrode high-level time period T1 during which the electric potential of the common electrode 22 is held at a high level H in the image-erasing step and the aforementioned common-electrode low-level time period T1 during which the electric potential of the common electrode 22 is held at a low level L in the image-erasing step is approximately one third of the length of each of the aforementioned common-electrode high-level time period T100 during which the electric potential of the common electrode 22 is held at a high level H in the image-writing step and the aforementioned common-electrode low-level time period T100 during which the electric potential of the common electrode 22 is held at a low level L in the image-writing step. However, the scope of the invention is not limited to such a specific example. As a non-limiting modification example thereof, the length of the time period T1 may be any other value as long as it is less than a half of the time period T100. Even with such a modified configuration, it is possible to erase an old image with enhanced image-erasing performance and reliability while effectively suppressing the occurrence of an afterimage.

In the foregoing description of the second driving method of an electrophoresis display device according to the present embodiment of the invention, it is explained that each column group of pixels 20 that are connected to the same single data line 50 is taken as the minimum unit of minute areas, which correspond to the first areas 201/second areas 202. However, the scope of the invention is not limited to such a specific example. For example, each multi-column group of pixels 20 that are connected to a set of the plural data lines 50 may be taken as the minimum unit of minute areas, which correspond to the first areas 201/second areas 202, as long as the first areas 201 and the second areas 202 are perceived by a user as the mixed color of gray when viewed with the naked eye at the time when the display colors of the first areas 201 and the second areas 202, which are arrayed adjacent to each other, are switched over in an alternate manner. In the foregoing description of the second driving method of an electrophoresis display device according to the present embodiment of the invention, it is explained that the time period of each of the first image-erasing sub step, the second image-erasing sub step, and the third image-erasing sub step corresponds to one cycle of a pulse signal that is supplied to the common electrode 22. However, the scope of the invention is not limited to such a specific example. As a non-limiting modification example thereof, the time period of the first image-erasing sub step, the second image-erasing sub step, and/or the third image-erasing sub step may correspond to not one but more than one cycle of a pulse signal that is supplied to the common electrode 22. The number of times of repetition of the first image erasing sub steps and the second image-erasing sub steps is not limited to the foregoing specific example. For example, the number of times of repetition of the first image erasing sub steps and the second image-erasing sub steps may be larger than that of the foregoing specific example. With the increased number of times of repetition of the first image-erasing sub steps and the second image-erasing sub steps, it is possible to ensure better agitation of the white particles 82 and the black particles 83, which results in further improved reduction/prevention of a residual image.

The electrophoresis display device 1 according to the present embodiment of the invention, which is operated by means of the second driving method explained above, offers the following advantageous effects of the invention. Each single-column group of pixels 20 that are connected to the same single data line 50 or each multi-column group of pixels 20 that are connected to a set of the plural data lines 50 is taken as the minimum unit of minute areas, which correspond to the first areas 201/second areas 202. Therefore, at the time when the display colors of the first areas 201 and the second areas 202 that are arrayed adjacent to each other are switched over in an alternate manner, they are always perceived by a user as the mixed color of gray when viewed with the naked eye. For this reason, during the execution of image-erasing operation, a user always perceives mixed gray display as viewed with the naked eye. Thus, the electrophoresis display device 1 according to the present embodiment of the invention and the second method for driving the electrophoresis display device 1 according to the present embodiment of the invention make it possible to achieve image-erasing operation free from the flashing problem. Through the repetition of the first image-erasing sub steps and the second image-erasing sub steps, display is reversed in an alternate manner so as to agitate the white particles 82 and the black particles 83. By this means, it is possible to improve image display quality while effectively preventing or suppressing a residual image.

The unit area size of the first areas 201 and the second areas 202 may be made larger than that of the foregoing specific example. As long as the modified area size thereof is not too large, a user perceives the mixed color of gray, making it possible to effectively prevent or suppress the aforementioned flashing phenomenon.

Furthermore, since it is not necessary to switch over the electric potentials of the data lines 50 when image data are inputted into the pixels 20 during a time period of the sequential scanning of the display area 30 via the scanning line 40, it is possible to reduce the burden of the control of the electric potential levels of the data lines 50.

In the second method for driving an electrophoresis display device according to the present embodiment of the invention explained above, it is assumed that the pulsed common switchover scheme, which is mentioned/explained in the foregoing description of the first electrophoresis-display-device driving method, is employed. Notwithstanding the foregoing, however, a medium-electric-potential driving scheme that is explained as a variation example of the first electrophoresis-display-device driving method may be used in place of the pulsed common switchover scheme. That is, instead of inputting a rectangular pulse signal into the common electrode 22 so as to cause the electric potential of the common electrode 22 to switch over between a high electric-potential level H and a low electric-potential level L in an alternate manner, a non-pulsed medium electric potential M that is an intermediate voltage level between a high electric potential H and a low electric potential may be applied to the common electrode 22 throughout the entire time period of the image-erasing step. The timing pattern/behavior of a non-pulse signal that is applied to the common electrode 22 as well as the timing pattern/behavior of pulse signals that are applied to the pixel electrode 21A of the pixel 20A and the pixel electrode 21B of the pixel 20B in such a modified second electrophoresis-display-device driving method is the same as that of the timing chart of FIG. 10.

Third Method for Driving Electrophoresis Display Device

Next, an explanation is given below of a third method for driving an electrophoresis display device according to an exemplary embodiment of the invention. In a brief non-limiting summary, the third method for driving an electrophoresis display device according to the present embodiment of the invention has the following features. Each row group of pixels 20 that are connected to the same single scanning line 40 is taken as the minimum unit of minute areas, which correspond to the first areas/second areas according to an aspect of the invention. White display and black display are provided in a horizontal stripe array pattern. The horizontal-stripe-arrayed white display and the horizontal-stripe-arrayed black display are switched over in an alternate manner for image erasure. A more detailed explanation of the features of the third method for driving an electrophoresis display device according to the present embodiment of the invention is given below. Taking an example of an arbitrary 5×5 matrix portion of the entire display area 30, the third method for driving an electrophoresis display device according to the present embodiment of the invention is explained below. The arbitrary 5×5 matrix area has the total twenty-five (25) pixels 20 that are arrayed in a matrix pattern made up of five rows and five columns. Each of five rows extends along the scanning line 40, that is, in the X direction. Each of five columns extends along the data line 50, that is, in the Y direction.

Figure 12:
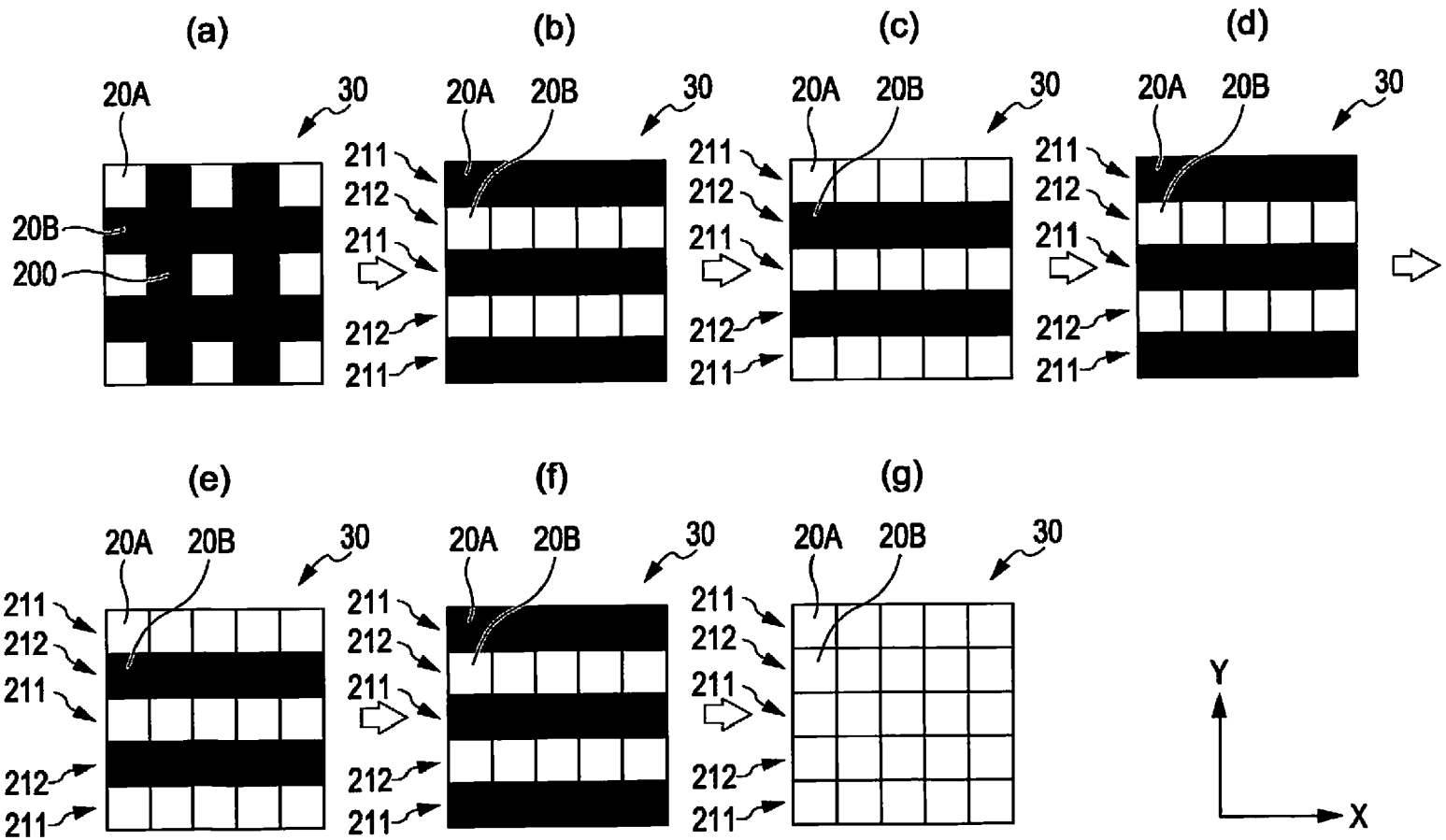
FIG. 12 is a display-state transition diagram that schematically illustrates an example of the image pattern of the display unit/area 30 of the electrophoresis display device 1 where such a display-state transition occurs in an image-erasing step of a third method for driving the electrophoresis display device 1 according to an exemplary embodiment of the invention.

FIG. 12 is a display-state transition diagram that schematically illustrates an example of the image pattern of the display unit 30 of an electrophoresis display device according to the third exemplary embodiment of the invention where such a display-state transition occurs at the time of image-erasing operation thereof. In the third method for driving an electrophoresis display device according to the present embodiment of the invention, each row group of pixels 20 that are connected to the same single scanning line 40 extending in the horizontal direction (i.e., X direction) is taken as the minimum unit of minute areas. A plurality of such very small areas is arrayed in a horizontal stripe pattern in the display area 30. As illustrated in FIG. 12, in the third method for driving an electrophoresis display device according to the present embodiment of the invention, first areas 211 and second areas 212 each of which is elongated along the extending direction of the corresponding scanning line 40 are arrayed adjacent to each other and in an alternate order as viewed in the extending direction of the data lines 50. Therefore, the first areas 211 and the second areas 212 are arrayed as horizontal stripes. In the process of image-erasing operation of the third method for driving an electrophoresis display device according to the present embodiment of the invention, an image 200, which has the shape of a lattice (a right-angled sharp sign #) as shown in the initial display state (a) of FIG. 12, is erased through a series of alternate switchovers of horizontal-stripe-arrayed black-and-white display between the first areas 211 and the second areas 212. In the following description of the third method for driving an electrophoresis display device according to the present embodiment of the invention, the uppermost and leftmost pixel is chosen as a non-limiting example of a plurality of pixels 20 that make up the first areas 211. The leftmost pixel in the second row from the top, which is adjacent to the uppermost and leftmost pixel, is chosen as a non-limiting example of a plurality of pixels 20 that make up the second areas 212. In the 5×5 matrix diagram of FIG. 12, the uppermost and leftmost pixel is denoted as 20A. The leftmost pixel in the second row from the top, which is adjacent to the uppermost and leftmost pixel 20A, is denoted as 20B. In the following description of the third method for driving an electrophoresis display device according to the present embodiment of the invention, our attention is directed to the display-state transition of these pixels 20A and 20B during the execution of image-erasing step thereof. It is assumed that the pulsed common switchover scheme is adopted in the following description of the third method for driving an electrophoresis display device according to the present embodiment of the invention without any intention to limit the technical scope thereof. The timing pattern/behavior of pulse signals that are applied to the pixel electrode 21A of the pixel 20A, the pixel electrode 21B of the pixel 20B, and the common electrode 22 in the third electrophoresis-display-device driving method described below is the same as that of the timing chart of FIG. 8, which schematically illustrates an example of the timing operation of the first electrophoresis-display-device driving method explained above. In addition, the migrating pattern/behavior of the white particles 82 and the black particles 83 in the third electrophoresis-display-device driving method described below is the same as that of FIGS. 9A, 9B, and 9C, which is a set of diagrams that schematically illustrates an example of the migration/movement of electrophoresis particles in the image-erasing step of the first electrophoresis-display-device driving method explained above. Therefore, the third method for driving an electrophoresis display device according to the present embodiment of the invention is explained while making reference to FIGS. 8 and 9 as well as FIG. 12.

The state diagram (a) of FIG. 12 corresponds to the image-holding step of FIG. B. As a result of the execution of the first image-erasing sub step, the display state of the display area 30 transitions from the initial state (a) of FIG. 12 to the next state (b) thereof. As illustrated in FIG. 8, a high electric potential H is supplied to the pixel electrode 21A of the pixel 20A in (i.e., throughout the entire time period T10 of) the first image-erasing sub step. During the same time period T10 of the first image-erasing sub step, one cycle of a pulse signal is inputted into the common electrode 22 so as to cause the electric potential of the common electrode 22 to switch over between a high electric-potential level H and a low electric-potential level L. As a result of the supplying of a high electric potential H to the pixel electrode 21A of the pixel 20A throughout the entire time period T10 of the first image-erasing sub step and the supplying of a pulsed common switchover signal to the common electrode 22 therein, during the second half of the time period T10 of the first image-erasing sub step throughout which a low electric potential L is applied to the common electrode 22, there occurs a voltage level difference between the electric potential (H) of the pixel electrode 21A of the pixel 20A and the electric potential (L) of the common electrode 22. Since the electric potential of the pixel electrode 21A of the pixel 20A is higher than the electric potential of the common electrode 22 throughout the second half of the time period T10 of the first image-erasing sub step, the black particles 83 are drawn to, and gather at, the common electrode 22 whereas the white particles 82 are drawn to, and gather at, the pixel electrode 21A of the pixel 20A. The migration behavior of the white particles 82 and the black particles 83 explained above is illustrated in FIG. 9A. As a result thereof, the operation state of the pixel 20A, which was in a white display state at its initial status, transitions into a black display state. That is, the display color of the first areas 211 is black after the completion of the first image-erasing sub step explained above. It should be remembered that the pixel 20A is taken as a non-limiting example out of the plurality of pixels 20 that make up the first areas 211. Any other pixel that is not in a white display state but in a black display state at its initial status may be taken as an alternative example of the plurality of pixels 20 that make up the first areas 211. If the pixel 20A is not in a white display state but in a black display state at its initial status, the white particles 82 and the black particles 83 do not migrate in the pixel 20A during the second half of the time period T10 of the first image-erasing sub step. Throughout the time period T10 of the first image-erasing sub step, a low electric potential L is applied to the pixel electrode 21B of the pixel 20B. As a result of the supplying of a low electric potential L to the pixel electrode 21B of the pixel 20B throughout the entire time period T10 of the first image-erasing sub step and the supplying of the pulsed common switchover signal to the common electrode 22 therein, during the first half of the time period T10 of the first image-erasing sub step throughout which a high electric potential H is applied to the common electrode 22, there occurs a voltage level difference between the electric potential (L) of the pixel electrode 21B of the pixel 20B and the electric potential (H) of the common electrode 22. Since the electric potential of the pixel electrode 21B of the pixel 20B is lower than the electric potential of the common electrode 22 throughout the first half of the time period T10 of the first image-erasing sub step, the white particles 82 are drawn to, and gather at, the common electrode 22 whereas the black particles 83 are drawn to, and gather at, the pixel electrode 21B of the pixel 20B. The migration behavior of the white particles 82 and the black particles 83 explained above is illustrated in FIG. 9A. As a result thereof, the operation state of the pixel 20B, which was in a black display state at its initial status, transitions into a white display state. That is, the display color of the second areas 212 is white after the completion of the first image-erasing sub step explained above. If the pixel 20B is not in a black display state but in a white display state at its initial status, the white particles 82 and the black particles 83 do not migrate in the pixel 20B during the first half of the time period T10 of the first image-erasing sub step. The image (200) displayed on the display area 30 transitions from the display state (a) of FIG. 12 into the display state (b) thereof as a result of the execution of the first image-erasing sub step explained above. Horizontal stripes are displayed after the execution of the first image-erasing sub step as shown in FIG. 12(*b*). The white particles 82 and the black particles 83 are agitated in the course of the execution of the first image-erasing sub step. Since very small black areas and very small white areas are arranged in an alternate array pattern in the display unit 30, or more specifically, in a horizontal stripe array pattern in the illustrated exemplary configuration of an electrophoresis display device according to the present embodiment of the invention, they are always perceived by a user as the mixed color of gray when viewed with the naked eye. For this reason, the aforementioned image problem of flashing does not arise, which is comfortable to users.

Subsequently, the image displayed on the display area 30 transitions from the display state (b) of FIG. 12 into the display state (c) thereof as a result of the execution of the second image-erasing sub step. Throughout the entire time period T10 of the second image-erasing sub step, a low electric potential L is applied to the pixel electrode 21A of the pixel 20A. During the same time period T10 of the second image-erasing sub step, (one cycle of) the pulsed common switchover signal is inputted into the common electrode 22 so as to cause the electric potential of the common electrode 22 to switch over between a high electric-potential level H and a low electric-potential level L. As a result of the supplying of a low electric potential L to the pixel electrode 21A of the pixel 20A throughout the entire time period T10 of the second image-erasing sub step and the supplying of the pulsed common switchover signal to the common electrode 22 therein, during the first half of the time period T10 of the second image-erasing sub step throughout which a high electric potential H is applied to the common electrode 22, there occurs a voltage level difference between the electric potential (L) of the pixel electrode 21A of the pixel 20A and the electric potential (H) of the common electrode 22. Since the electric potential of the pixel electrode 21A of the pixel 20A is lower than the electric potential of the common electrode 22 throughout the first half of the time period T10 of the second image-erasing sub step, the white particles 82 are drawn to, and gather at, the common electrode 22 whereas the black particles 83 are drawn to, and gather at, the pixel electrode 21A of the pixel 20A. The migration behavior of the white particles 82 and the black particles 83 explained above is illustrated in FIG. 9B. As a result thereof, the operation state of the pixel 20A that was in a black display state transitions into a white display state. That is, the display color of the first areas 211 is white after the completion of the second image-erasing sub step explained above. Throughout the time period T10 of the second image-erasing sub step, a high electric potential H is applied to the pixel electrode 21B of the pixel 20B. As a result of the supplying of a high electric potential H to the pixel electrode 21B of the pixel 20B throughout the entire time period T10 of the second image-erasing sub step and the supplying of the pulsed common switchover signal to the common electrode 22 therein, during the second half of the time period T10 of the second image-erasing sub step throughout which a low electric potential L is applied to the common electrode 22, there occurs a voltage level difference between the electric potential (H) of the pixel electrode 21B of the pixel 20B and the electric potential (L) of the common electrode 22. Since the electric potential of the pixel electrode 21B of the pixel 20B is higher than the electric potential of the common electrode 22 throughout the second half of the time period T10 of the second image-erasing sub step, the black particles 83 are drawn to, and gather at, the common electrode 22 whereas the white particles 82 are drawn to, and gather at, the pixel electrode 21B of the pixel 20B. The migration behavior of the white particles 82 and the black particles 83 explained above is illustrated in FIG. 9B. As a result thereof, the operation state of the pixel 20B that was in a white display state transitions into a black display state. That is, the display color of the second areas 212 is black after the completion of the second image-erasing sub step explained above. The image displayed on the display area 30 transitions from the display state (b) of FIG. 12 into the display state (c) thereof as a result of the execution of the second image-erasing sub step explained above. Horizontal stripes of reversed display color are displayed after the execution of the second image-erasing sub step as shown in FIG. 12(*c*). The white particles 82 and the black particles 83 are agitated in the course of the execution of the second image-erasing sub step. Very small black areas and very small white areas whose display colors are reversed in the course of or as a result of the execution of the second image-erasing sub step explained above are arranged in an alternate array pattern in the display unit 30, or more specifically, in a horizontal stripe array pattern in the illustrated exemplary configuration of an electrophoresis display device according to the present embodiment of the invention. Therefore, they are always perceived by a user as the mixed color of gray when viewed with the naked eye. That is, the reversal/turnover/switchover of display colors thereof is not observed. For this reason, the aforementioned image problem of flashing does not arise, which is comfortable to users.

In the driving method of an electrophoresis display device according to the present embodiment of the invention, the first image-erasing sub step is performed again after the second image-erasing sub step explained above. Thereafter, the second image-erasing sub step is performed again after the first image-erasing sub step, followed by the execution of the first image-erasing sub step again. That is, the display state of the display area 30 transitions from FIG. 12(*c*) to FIG. 12(*f*) in a sequential manner as a result of the repetitive execution of the first image-erasing sub step (from the display state (c) of FIG. 12 to the display state (d) thereof), the second image-erasing sub step (from the display state (d) of FIG. 12 to the display state (e) thereof), and the first image-erasing sub step (from the display state (e) of FIG. 12 to the display state (f) thereof). The white particles 82 and the black particles 83 are further agitated through the consecutive reversal (e.g., turnover, or switchover, though not limited thereto) of display colors (e.g., display states, or display image, though not limited thereto) from FIG. 12(*c*) to FIG. 12(*f*). Very small black areas and very small white areas whose display colors are reversed in the course of or as a result of the execution of the second (from (b) to (c)) and subsequent (from (c) to (f)) image-erasing sub steps explained above are arranged in an alternate array pattern in the display unit 30, or more specifically, in a horizontal stripe array pattern in the illustrated exemplary configuration of an electrophoresis display device according to the present embodiment of the invention. Therefore, they are always perceived by a user as the mixed color of gray when viewed with the naked eye. For this reason, the aforementioned image problem of flashing does not arise, which is comfortable to users.

After the full and sufficient agitation of the white particles 82 and the black particles 83, the process moves onto the third image-erasing sub step of the image-erasing step from the first image-erasing sub step thereof (note that the third image-erasing sub step follows not the second image-erasing sub step but the first image-erasing sub step). More specifically, throughout the entire time period of the third image-erasing sub step that is performed as the last step of the image erasure step explained herein, a low electric potential L is applied to both of the pixel electrode 21A of the pixel 20A and the pixel electrode 21B of the pixel 20B. This means that a low electric potential L is applied to every pixel electrode in the third image-erasing sub step thereof. On the other hand, during the same time period of the third image-erasing sub step, one cycle of a pulse signal (i.e., pulsed common switchover signal) is inputted into the common electrode 22. Accordingly, during the first half of the time period of the third image-erasing sub step throughout which a high electric potential H is applied to the common electrode 22, there occurs a voltage level difference between the electric potential (L) of the pixel electrode 21A of the pixel 20A/the electric potential (L) of the pixel electrode 21B of the pixel 20B and the electric potential (H) of the common electrode 22. That is, each of the electric potential of the pixel electrode 21A of the pixel 20A and the electric potential of the pixel electrode 21B of the pixel 20B is lower than the electric potential of the common electrode 22 throughout the first half of the time period of the third image-erasing sub step. Because of the voltage level difference between the electric potential (L) of the pixel electrode 21A of the pixel 20A and the electric potential (H) of the common electrode 22, the white particles 82 are drawn to, and gather at, the common electrode 22 whereas the black particles 83 are drawn to, and gather at, the pixel electrode 21A of the pixel 20A, which was in a black display state as a result of the completion of the preceding first image-erasing sub step prior to the execution of the third image-erasing sub step described herein. The migration behavior of the white particles 82 and the black particles 83 in the pixel 20A explained above is illustrated in FIG. 9C. On the other hand, despite the fact that there occurs a voltage level difference between the electric potential (L) of the pixel electrode 21B of the pixel 20B and the electric potential (H) of the common electrode 22 during the first half of the time period of the third image-erasing sub step, the white particles 82 and the black particles 83 do not move in the pixel 20B because the pixel 20B was in a white display state as a result of the completion of the preceding first image-erasing sub step prior to the execution of the third image-erasing sub step described herein. The stationary behavior of the white particles 82 and the black particles 83 in the pixel 20B explained above is illustrated in FIG. 9C. As a result thereof, the entire pixel area of the display unit 30, which includes the pixels 20A and 20B, is in a white display state as illustrated in the state diagram FIG. 12(*g*) after the completion of the third image-erasing sub step explained above. The image erasure step is finished after the completion of the third image-erasing sub step described above. Then, the process moves onto the next image-writing step.

As in each of the first driving method of an electrophoresis display device and the second driving method of an electrophoresis display device explained earlier, in the third driving method of an electrophoresis display device according to the present embodiment of the invention, the length of each of the aforementioned common-electrode high-level time period T100 during which the electric potential of the common electrode 22 is held at a high level H in the image-writing step and the aforementioned common-electrode low-level time period T100 during which the electric potential of the common electrode 22 is held at a low level L in the image-writing step is set as approximately 0.3 s, whereas the length of each of the aforementioned common-electrode high-level time period T1 during which the electric potential of the common electrode 22 is held at a high level H in the image-erasing step and the aforementioned common-electrode low-level time period T1 during which the electric potential of the common electrode 22 is held at a low level L in the image-erasing step is set as approximately 0.1 s. That is, as in each of the first driving method of an electrophoresis display device and the second driving method of an electrophoresis display device explained earlier, in the third driving method of an electrophoresis display device according to the present embodiment of the invention, the writing level of the image-erasing step is relatively low (i.e., "weaker writing") in comparison with that of the image-writing step. Because of the lesser writing intensity in the pixel-writing operation of the image erasure step, to be exact, the white particles 82/black particles 83 do not move completely to the pixel electrode 21/common electrode 22 when they migrate toward the pixel electrode 21/common electrode 22 during the execution of the image erasure step. For this reason, it is possible to significantly reduce or completely eliminate the risk of a residual image. The reason why the writing level of the image-erasing step is relatively low in comparison with that of the image-writing step is that the purpose of writing (i.e., image display) performed in the image-erasing step is to merely erase an old image. That is, it simply aims to fully agitate the white particles 82 and the black particles 83. The agitation of the white particles 82 and the black particles 83 to a sufficient level makes the migration behavior (i.e., movement) thereof smoother. By this means, it is possible to display an image that is written in the image-writing step more clearly. In addition, because of the lesser writing intensity in the pixel-writing operation of the image erasure step, a gray-scale color that is displayed in each pixel is, in an exact sense, not pure black/white (i.e., perfect black/white). For this reason, it is substantially more likely for a user to perceive the mixed color of gray during the execution of the image-erasing step, making it possible to effectively prevent or suppress the aforementioned flashing phenomenon. In the foregoing description of the third driving method of an electrophoresis display device according to the present embodiment of the invention, it is explained that the length of each of the aforementioned common-electrode high-level time period T1 during which the electric potential of the common electrode 22 is held at a high level H in the image-erasing step and the aforementioned common-electrode low-level time period T1 during which the electric potential of the common electrode 22 is held at a low level L in the image-erasing step is approximately one third of the length of each of the aforementioned common-electrode high-level time period T100 during which the electric potential of the common electrode 22 is held at a high level H in the image-writing step and the aforementioned common-electrode low-level time period T100 during which the electric potential of the common electrode 22 is held at a low level L in the image-writing step. However, the scope of the invention is not limited to such a specific example. As a non-limiting modification example thereof, the length of the time period T1 may be any other value as long as it is less than a half of the time period T100. Even with such a modified configuration, it is possible to erase an old image with enhanced image-erasing performance and reliability while effectively suppressing the occurrence of an afterimage.

In the foregoing description of the third driving method of an electrophoresis display device according to the present embodiment of the invention, it is explained that each row group of pixels 20 that are connected to the same single scanning line 40 is taken as the minimum unit of minute areas, which correspond to the first areas 211/second areas 212. However, the scope of the invention is not limited to such a specific example. For example, each multi-row group of pixels 20 that are connected to a set of the plural scanning lines 40 may be taken as the minimum unit of minute areas, which correspond to the first areas 211/second areas 212, as long as the first areas 211 and the second areas 212 are perceived by a user as the mixed color of gray when viewed with the naked eye at the time when the display colors of the first areas 211 and the second areas 212, which are arrayed adjacent to each other, are switched over in an alternate manner. In the foregoing description of the third driving method of an electrophoresis display device according to the present embodiment of the invention, it is explained that the time period of each of the first image-erasing sub step, the second image-erasing sub step, and the third image-erasing sub step corresponds to one cycle of a pulse signal that is supplied to the common electrode 22. However, the scope of the invention is not limited to such a specific example. As a non-limiting modification example thereof, the time period of the first image-erasing sub step, the second image-erasing sub step, and/or the third image-erasing sub step may correspond to not one but more than one cycle of a pulse signal that is supplied to the common electrode 22. The number of times of repetition of the first image erasing sub steps and the second image-erasing sub steps is not limited to the foregoing specific example. For example, the number of times of repetition of the first image erasing sub steps and the second image-erasing sub steps may be larger than that of the foregoing specific example. With the increased number of times of repetition of the first image-erasing sub steps and the second image-erasing sub steps, it is possible to ensure better agitation of the white particles 82 and the black particles 83, which results in further improved reduction/prevention of a residual image.

The electrophoresis display device 1 according to the present embodiment of the invention, which is operated by means of the third driving method explained above, offers the following advantageous effects of the invention. Each single-row group of pixels 20 that are connected to the same single scanning line 40 or each multi-column group of pixels 20 that are connected to a set of the plural scanning lines 40 is taken as the minimum unit of minute areas, which correspond to the first areas 211/second areas 212. Therefore, at the time when the display colors of the first areas 211 and the second areas 212 that are arrayed adjacent to each other are switched over in an alternate manner, they are always perceived by a user as the mixed color of gray when viewed with the naked eye. For this reason, during the execution of image-erasing operation, a user always perceives mixed gray display as viewed with the naked eye. Thus, the electrophoresis display device 1 according to the present embodiment of the invention and the third method for driving the electrophoresis display device 1 according to the present embodiment of the invention make it possible to achieve image-erasing operation free from the flashing problem. Through the repetition of the first image-erasing sub steps and the second image-erasing sub steps, display is reversed in an alternate manner so as to agitate the white particles 82 and the black particles 83. By this means, it is possible to improve image display quality while effectively preventing or suppressing a residual image.

Furthermore, when image data are inputted into the pixels 20, it is just enough to set the same single electric potential level for all of the data lines 50 because the same single image/pixel data are inputted into each row group of pixels 20 that are connected to the same single scanning line 40. Therefore, it is possible to reduce the burden of the control of the electric potential levels of the data lines 50 in the image-erasing step.

In the third method for driving an electrophoresis display device according to the present embodiment of the invention explained above, it is assumed that the pulsed common switchover scheme, which is mentioned/explained in the foregoing description of the first electrophoresis-display-device driving method, is employed. Notwithstanding the foregoing, however, a medium-electric-potential driving scheme that is explained as a variation example of the first electrophoresis-display-device driving method may be used in place of the pulsed common switchover scheme. That is, instead of inputting a rectangular pulse signal into the common electrode 22 so as to cause the electric potential of the common electrode 22 to switch over between a high electric-potential level H and a low electric-potential level L in an alternate manner, a non-pulsed medium electric potential M that is an intermediate voltage level between a high electric potential H and a low electric potential may be applied to the common electrode 22 throughout the entire time period of the image-erasing step. The timing pattern/behavior of a non-pulse signal that is applied to the common electrode 22 as well as the timing pattern/behavior of pulse signals that are applied to the pixel electrode 21A of the pixel 20A and the pixel electrode 21B of the pixel 20B in such a modified third electrophoresis-display-device driving method is the same as that of the timing chart of FIG. 10.

Electronic Apparatus

Figure 13:
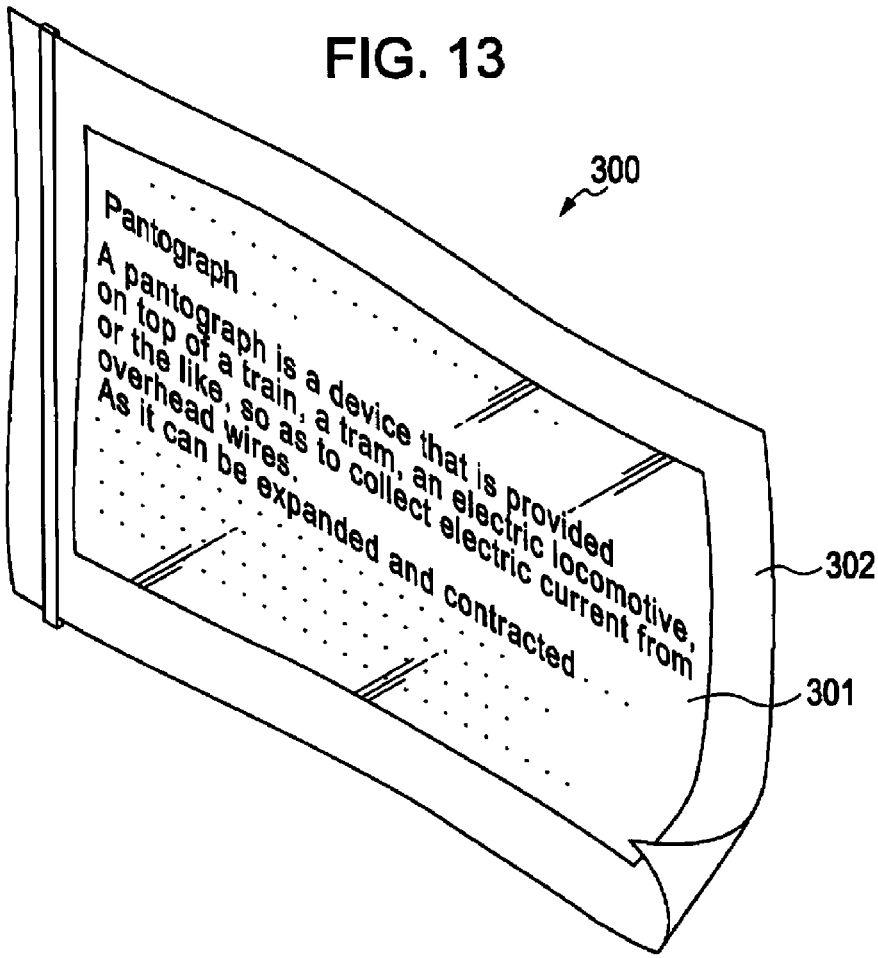
FIG. 13 is a perspective view that schematically illustrates an example of the configuration of a sheet of electronic paper 300.

The electrophoresis display device 1 according to the exemplary embodiments of the invention explained above and variation/modification examples thereof can be applied to a variety of electronic apparatuses. In the following description, an explanation is given of a few non-limiting examples of an electronic apparatus that is provided with the electrophoresis display device 1 according to an exemplary embodiment of the invention. FIG. 13 is a perspective view that schematically illustrates an example of the configuration of a sheet of electronic paper 300. The electronic paper 300 has the electrophoresis display device 1 according to an exemplary embodiment of the invention as its display area 301. The electronic paper 300 has a thin body portion 302. The thin body portion 302 of the electronic paper 300 is made of a sheet material that has almost the same texture and flexibility as those of conventional paper (i.e., normal non-electronic paper). The electrophoresis display device 1 according to an exemplary embodiment of the invention is provided on the surface of the thin body portion 302 of the electronic paper 300.

Figure 14:
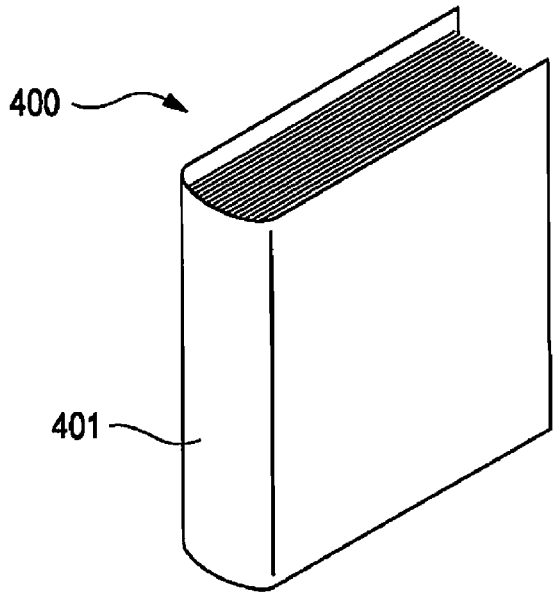
FIG. 14 is a perspective view that schematically illustrates an example of the configuration of an electronic notebook 400.
Figure 15:
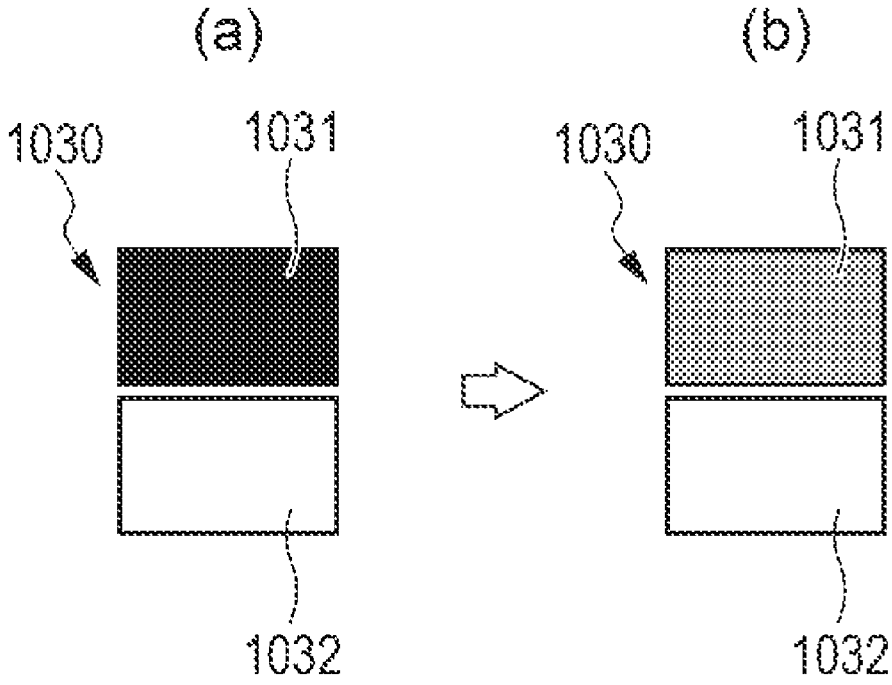
FIG. 15 CONVENTIONAL ART
FIG. 15 is a diagram that schematically illustrates an example of the occurrence of an afterimage at the time of image-erasing operation of an electrophoresis display device of the related art.
Figure 16:
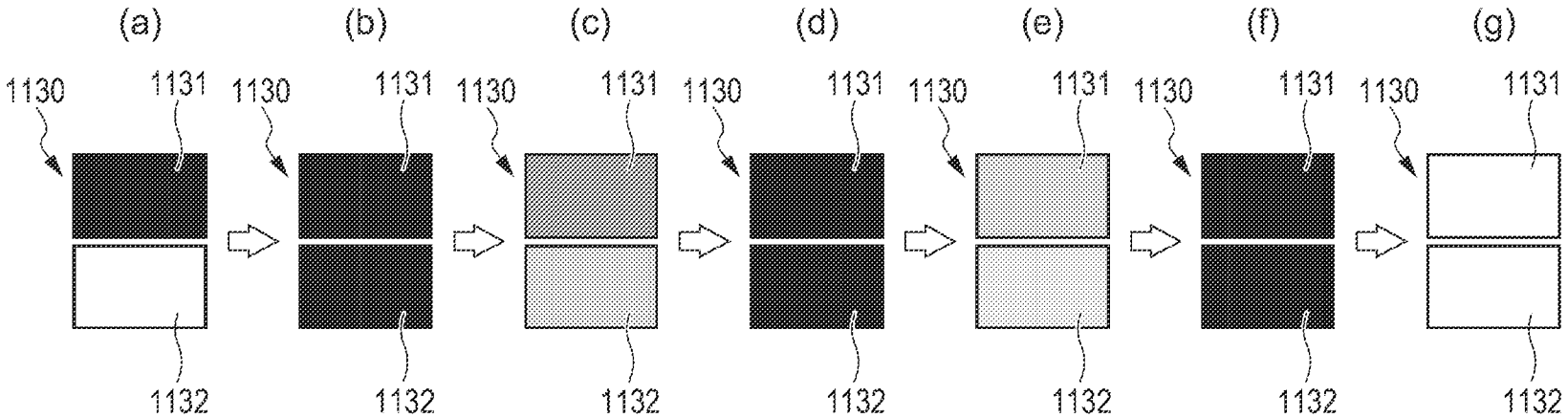
FIG. 16 CONVENTIONAL ART
FIG. 16 is a display-state transition diagram that schematically illustrates an example of the image pattern of the display unit/area 1130 of an electrophoresis display device of the related art.
Figure 17A:
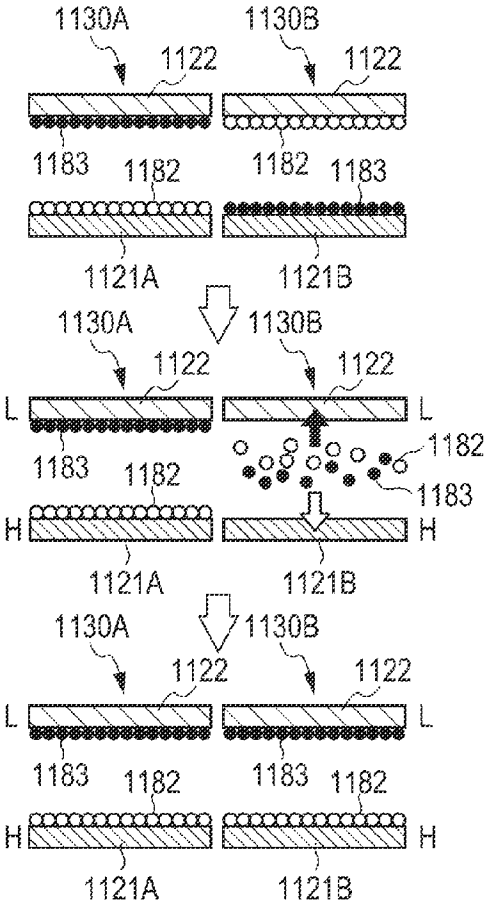
FIG. 17A CONVENTIONAL ART
FIGS. 17A and 17B is a set of diagrams that schematically illustrates an example of the migration behavior of electrophoresis particles at the time of image-erasing operation of an electrophoresis display device of the related art.
Figure 17B:
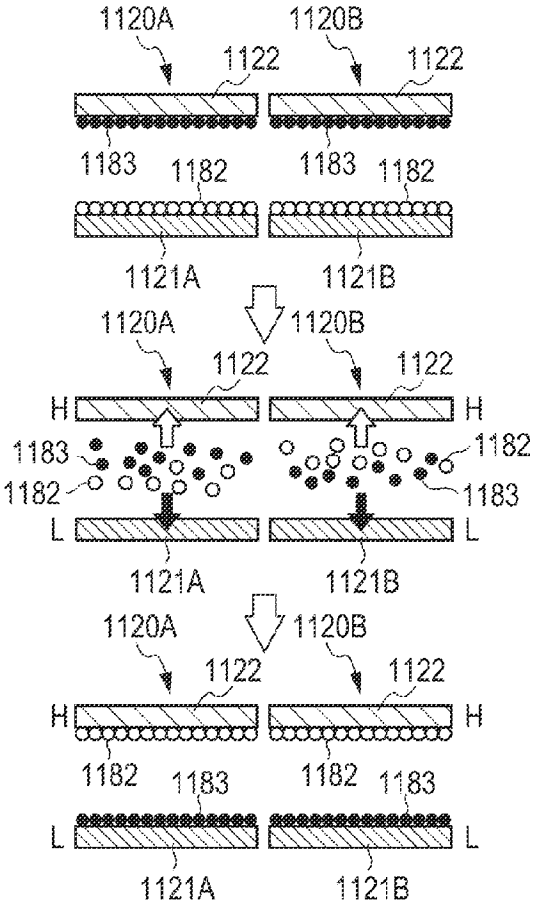
FIG. 17B CONVENTIONAL ART

FIG. 14 is a perspective view that schematically illustrates an example of the configuration of an electronic notebook 400. The electronic notebook 400 has a plurality of sheets of the electronic paper 300 illustrated in FIG. 13. The electronic notebook 400 is further provided with a book jacket 401, which covers the sheets of electronic paper 300. The book jacket 401 is provided with a display data input unit that supplies (i.e., inputs) display data that has been sent from, for example, an external device. The display data input unit is not shown in the drawing. Having such a configuration, the electronic notebook 400 illustrated in FIG. 14 is capable of changing and/or updating (i.e., overwriting) display content in accordance with the supplied display data without any necessity to unbind the electronic paper 300.

The electronic paper 300 that has the electrophoresis display device 1 according to an exemplary embodiment of the invention as its display area 301 makes it possible to achieve significant reduction in flashing at the time of display-updating operation. The electronic notebook 400 that has a plurality of sheets of the electronic paper 300 offers the same advantage of significant reduction in flashing at the time of display-updating operation. Moreover, the electronic paper 300 that has the electrophoresis display device 1 according to an exemplary embodiment of the invention as its display area 301 makes it possible to avoid the occurrence of any afterimage problem and thus offer enhanced image display quality. The electronic notebook 400 that has a plurality of sheets of the electronic paper 300 offers the same advantage: that is, it makes it possible to avoid the occurrence of any afterimage problem and thus offer enhanced image display quality.

An electrophoresis display device according to an aspect of the invention can be implemented as a component of a variety of electronic apparatuses, including but not limited to, a watch, a mobile phone, and a portable audio device in addition to the electronic paper 300 and the electronic notebook 400 described above. In each of non-limiting application examples enumerated above, the invention provides, as an advantage of some aspects thereof, an electronic apparatus that makes it possible to significantly reduce flashing at the time of display-updating operation. Furthermore, in each of non-limiting application examples enumerated above, the invention provides, as another advantage of some aspects thereof, an electronic apparatus that makes it possible to avoid the occurrence of any afterimage problem and thus offer enhanced image display quality.

The entire disclosure of Japanese Patent Application No. 2007-224395, filed Aug. 30, 2007 is expressly incorporated by reference herein.

What is claimed is:

1. A method for driving an electrophoresis display device that has a pair of substrates that sandwich an electrophoresis element that contains, without any limitation thereto, a plurality of electrophoresis particles and further has a displaying section that is made up of a plurality of pixels, the driving method of the electrophoresis display device comprising:

an image-erasing step in which an old image displayed on the displaying section of the electrophoresis display device is erased, the image-erasing step of the driving method of the electrophoresis display device further including a first image-erasing sub step of displaying a first gradation in each of the pixels of a first area and displaying a second gradation in each of the pixels of a second area, where the pixels are grouped into the first area and the second area arrayed adjacent to each other in the displaying section of the electrophoresis display device, the first area being made up of either a single pixel or plural pixels, the second area being also made up of either a single pixel or plural pixels; and a second image-erasing sub step of displaying the second gradation in each of the pixels of the first area and displaying the first gradation in each of the pixels of the second area, wherein:

each of the pixels of the first area and the second area comprises a pixel electrode formed on one of the pair of substrates and a common electrode formed on the other of the pair of substrates, a first electric potential is inputted into the pixel electrodes of the first area and a second electric potential is inputted into the pixel electrodes of the second area during the entirety of the first image-erasing sub step, the second electric potential is inputted into the pixel electrodes of the first area and the first electric potential is inputted into the pixel electrodes of the second area during the entirety of the second image-erasing sub step, and the first electric potential is applied to the common electrode during a first half of each of the first and second image-erasing sub steps and the second electric potential is applied to the common electrode during a second half of each of the first and second image-erasing sub steps.

2. The method for driving the electrophoresis display device according to claim 1, wherein the first image-erasing sub step and the second image-erasing sub step are executed more than one time in an alternate manner.

3. The method for driving the electrophoresis display device according to claim 1, wherein a data line and a scanning line that intersect with each other are formed in the displaying section of the electrophoresis display device;

the pixel is formed at a position corresponding to the intersection of the data line and the scanning line;

a plurality of the first areas and a plurality of the second areas are formed in the displaying section of the electrophoresis display device; and the first areas and the second areas are arrayed in a grid pattern along the extending direction of the data line and the extending direction of the scanning line.

4. The method for driving the electrophoresis display device according to claim 3, wherein each of the first areas is made up of not plural pixels but a single pixel; and each of the second areas is also made up of not plural pixels but a single pixel.

5. The method for driving the electrophoresis display device according to claim 1, wherein a data line and a scanning line that intersect with each other are formed in the displaying section of the electrophoresis display device;

the pixel is formed at a position corresponding to the intersection of the data line and the scanning line;

the first area is elongated along the extending direction of the data line; and the second area is also elongated along the extending direction of the data line.

6. The method for driving the electrophoresis display device according to claim 1, wherein a data line and a scanning line that intersect with each other are formed in the displaying section of the electrophoresis display device;

the pixel is formed at a position corresponding to the intersection of the data line and the scanning line;

the first area is elongated along the extending direction of the scanning line; and the second area is also elongated along the extending direction of the scanning line.

7. The method for driving the electrophoresis display device according to claim 1 further comprising an image-writing step in which an image is displayed in the displaying section of the electrophoresis display device, the common electrode is formed on the other of the pair of substrates in such a manner that the common electrode is provided opposite to the pixel electrodes with the electrophoresis element being interposed therebetween;

either the first electric potential or the second electric potential is inputted into the pixel electrodes in the image-writing step; and a signal that causes the electric potential level of the common electrode to switch over between the first electric potential and the second electric potential in an alternate manner is inputted into the common electrode in each of the first image-erasing sub step of the image-erasing step, the second image-erasing sub step of the image-erasing step, and the image-writing step.

8. The method for driving the electrophoresis display device according to claim 7, wherein each of the length of the time period of the first image-erasing sub step and the length of the time period of the second image-erasing sub step is shorter than each of the length of the time period during which the electric potential level of the signal that is inputted into the common electrode in the image-writing step in which an image is displayed in the displaying section of the electrophoresis display device is held at the first electric potential and the length of the time period during which the electric potential level of the signal that is inputted into the common electrode in the image-writing step in which an image is displayed in the displaying section of the electrophoresis display device is held at the second electric potential.

9. An electrophoresis display device comprising:

a pair of substrates that sandwich an electrophoresis element that contains, without any limitation thereto, a plurality of electrophoresis particles;

a displaying section that is made up of a plurality of pixels; and a controlling section that controls the plurality of pixels, wherein the controlling section executes image-erasing operation through which an old image displayed on the displaying section is erased; and the image-erasing operation executed by the controlling section includes:

a first image-erasing operation in which a first gradation is displayed in each of the pixels of a first area whereas a second gradation is displayed in each of the pixels of a second area, where the pixels are grouped into the first area and the second area arrayed adjacent to each other in the displaying section, the first area being made up of either a single pixel or plural pixels, the second area being also made up of either a single pixel or plural pixels; and a second image-erasing operation in which the second gradation is displayed in each of the pixels of the first area whereas the first gradation is displayed in each of the pixels of the second area, wherein:

each of the pixels of the first area and the second area comprises a pixel electrode formed on one of the pair of substrates and a common electrode formed on the other of the pair of substrates, a first electric potential is inputted into the pixel electrodes of the first area and a second electric potential is inputted into the pixel electrodes of the second area during the entirety of the first image-erasing sub step, the second electric potential is inputted into the pixel electrodes of the first area and the first electric potential is inputted into the pixel electrodes of the second area during the entirety of the second image-erasing sub step, and the first electric potential is applied to the common electrode during a first half of each of the first and second image-erasing sub steps and the second electric potential is applied to the common electrode during a second half of each of the first and second image-erasing sub steps.

10. The electrophoresis display device according to claim 9, wherein the controlling section executes the first image-erasing operation and the second image-erasing operation more than one time in an alternate manner.

11. The electrophoresis display device according to claim 9, wherein a data line and a scanning line that intersect with each other are formed in the displaying section;

the pixel is formed at a position corresponding to the intersection of the data line and the scanning line;

a plurality of the first areas and a plurality of the second areas are formed in the displaying section of the electrophoresis display device; and the first areas and the second areas are arrayed in a grid pattern along the extending direction of the data line and the extending direction of the scanning line.

12. The electrophoresis display device according to claim 11, wherein each of the first areas is made up of not plural pixels but a single pixel; and each of the second areas is also made up of not plural pixels but a single pixel.

13. The electrophoresis display device according to claim 9, wherein a data line and a scanning line that intersect with each other are formed in the displaying section;

the pixel is formed at a position corresponding to the intersection of the data line and the scanning line;

the first area is elongated along the extending direction of the data line; and the second area is also elongated along the extending direction of the data line.

14. The electrophoresis display device according to claim 9, wherein a data line and a scanning line that intersect with each other are formed in the displaying section;

the pixel is formed at a position corresponding to the intersection of the data line and the scanning line;

the first area is elongated along the extending direction of the scanning line; and the second area is also elongated along the extending direction of the scanning line.

15. The electrophoresis display device according to claim 9 further executing an image-writing operation through which an image is displayed in the displaying section, the common electrode is formed on the other of the pair of substrates in such a manner that the common electrode is provided opposite to the pixel electrode with the electrophoresis element being interposed therebetween;

either the first electric potential or the second electric potential is inputted into the pixel electrodes in the image-writing operation; and a signal that causes the electric potential level of the common electrode to switch over between the first electric potential and the second electric potential in an alternate manner is inputted into the common electrode in each of the first image-erasing operation of the image-erasing operation, the second image-erasing operation of the image-erasing operation, and the image-writing operation.

16. The electrophoresis display device according to claim 15, wherein each of the length of the time period of the first image-erasing operation and the length of the time period of the second image-erasing operation is shorter than each of the length of the time period during which the electric potential level of the signal that is inputted into the common electrode in the image-writing operation in which an image is displayed in the displaying section is held at the first electric potential and the length of the time period during which the electric potential level of the signal that is inputted into the common electrode in the image-writing operation in which an image is displayed in the displaying section is held at the second electric potential.

17. An electronic apparatus that is provided with the electrophoresis display device according to claim 9.

18. The method for driving the electrophoresis display device according to claim 1, wherein the first electric potential is applied to the common electrode during the entire first half of each of the first and second image-erasing sub steps and the second electric potential is applied to the common electrode during the entire second half of each of the first and second image-erasing sub steps.

* * * * *